US009297293B2

(12) United States Patent
Wakamoto et al.

(10) Patent No.: US 9,297,293 B2
(45) Date of Patent: Mar. 29, 2016

(54) COOLING STRUCTURE OF INTERNAL COMBUSTION ENGINE

(71) Applicant: HONDA MOTOR CO., LTD., Tokyo (JP)

(72) Inventors: Shinji Wakamoto, Wako (JP); Nobuyuki Ohta, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/220,136

(22) Filed: Mar. 20, 2014

(65) Prior Publication Data

US 2014/0283763 A1 Sep. 25, 2014

(30) Foreign Application Priority Data

Mar. 22, 2013 (JP) ..... 2013-059958
Feb. 25, 2014 (JP) ..... 2014-033806

(51) Int. Cl.
*F02F 3/02* (2006.01)
*F01P 3/02* (2006.01)
*F02F 1/10* (2006.01)

(52) U.S. Cl.
CPC ... *F01P 3/02* (2013.01); *F02F 1/10* (2013.01); *F01P 2003/028* (2013.01); *F02F 2001/104* (2013.01)

(58) Field of Classification Search
CPC . F01P 3/02; F01P 2003/024; F01P 2003/028; F01P 2011/0228; F02F 1/10; F02F 2001/106; F02F 1/14; F02F 2001/104
USPC ..... 123/41.01
See application file for complete search history.

(56) References Cited

U.S. PATENT DOCUMENTS

2005/0279315 A1* 12/2005 Yamamura et al. ..... 123/193.3

FOREIGN PATENT DOCUMENTS

DE 102013222777 * 6/2014 ..... F02F 1/14
JP 4770828 B2 6/2009
JP 2012-225246 11/2012

* cited by examiner

*Primary Examiner* — Lindsay Low
*Assistant Examiner* — Kevin Lathers
(74) *Attorney, Agent, or Firm* — Mori & Ward, LLP

(57) ABSTRACT

A cooling structure of an internal combustion engine includes a cylinder block, a cylinder head and a gasket. In a cross-section defined through an inter-bore region and perpendicular to the cylinder bank center line, a first end and a second end which face a cylinder bank center line are disposed nearer to the cylinder bank center line than a third end and a fourth end which face the cylinder bank center line, respectively. In the cross-section, a fifth end of a first communication hole facing the cylinder bank center line is provided between the first end of the head opening and the third end of the block opening. In the cross-section, a sixth end of a second communication hole facing the cylinder bank center line is provided between the second end of the head opening and the fourth end of the block opening.

10 Claims, 13 Drawing Sheets

COOLING STRUCTURE OF INTERNAL COMBUSTION ENGINE

CROSS-REFERENCE TO RELATED APPLICATIONS

The present application claims priority under 35 U.S.C. §119 to Japanese Patent Application No. 2013-059958, filed Mar. 22, 2013 and Japanese Patent Application No. 2014-033806, filed Feb. 25, 2014, which are entitled "Cooling Structure of Internal Combustion Engine." The contents of these applications are incorporated herein by reference in their entirety.

BACKGROUND

1. Field

The present disclosure relates to a cooling structure of an internal combustion engine.

2. Description of the Related Art

Development of technology has been pursued to increase the efficiency in cooling an inter-bore region (also referred to as an inter-axis region) that is located between adjacent cylinder bores and extends in the width direction of a cylinder block in a cooling structure of an internal combustion engine. For example, Japanese Unexamined Patent Application Publication No. 2012-225246 (claim 1, FIG. 2) discloses a structure in which an inter-bore region is provided with an inter-bore cooling passage, a gasket hole is provided outwardly of an opening of the inter-bore cooling passage in the direction of the width of a cylinder block, the opening facing the cylinder head, and a head hole is further provided outwardly of the gasket hole in the width direction for the purpose of increasing the amount of coolant by reducing a pressure loss. Japanese Patent No. 4770828 (claim 1, FIG. 3) discloses a gasket, in which a coolant hole, which communicates with coolant passages formed in a cylinder head and a cylinder block, is extended for an opening of a coolant passage only in the direction away from the center line of arranged bore holes (also referred to as the cylinder bank center line) in a gasket which is formed in an region between adjacent bore holes, the opening through the top surface of the cylinder block.

SUMMARY

According to one aspect of the present invention, a cooling structure of an internal combustion engine includes a cylinder block, a cylinder head and a gasket. The cylinder block includes a block-side coolant passage which surrounds an entire circumference of cylinder bores which are arranged along a cylinder bank center line in the internal combustion engine. The block-side coolant passage has a block opening which is open through a first surface of the cylinder block. The cylinder head includes a head-side coolant passage having a head opening which is open through a second surface of the cylinder head. The second surface faces the cylinder block. The first surface of the cylinder block faces the cylinder head. The gasket is provided between the cylinder block and the cylinder head. The gasket has a first communication hole and a second communication hole provided on an opposite side of the first communication hole with respect to the cylinder bank center line. Each of the first communication hole and the second communication hole communicates with the block opening and the head opening in an inter-bore region which separates adjacent cylinder bores. The head opening includes a first end and a second end provided on an opposite side of the first end with respect to the cylinder bank center line. The block opening includes a third end and a fourth end provided on an opposite side of the third end with respect to the cylinder bank center line. In a cross-section defined through the inter-bore region and perpendicular to the cylinder bank center line, the first end and the second end which face the cylinder bank center line are disposed nearer to the cylinder bank center line than the third end and the fourth end which face the cylinder bank center line, respectively. In the cross-section, a fifth end of the first communication hole facing the cylinder bank center line is provided between the first end of the head opening and the third end of the block opening. In the cross-section, a sixth end of the second communication hole facing the cylinder bank center line is provided between the second end of the head opening and the fourth end of the block opening.

According to another aspect of the present invention, a cooling structure of an internal combustion engine includes a cylinder block, a cylinder head, and a gasket. The cylinder block includes a block-side coolant passage which surrounds an entire circumference of the cylinder bores which are arranged along a cylinder bank center line in the internal combustion engine. The block-side coolant passage has a block opening which is open through a first surface of the cylinder block. The cylinder head includes a head-side coolant passage. The head-side coolant passage has a head opening which is open through a surface of the cylinder head. The second surface faces the cylinder block. The first surface faces the cylinder head. The gasket is provided between the cylinder block and the cylinder head. The gasket has a first communication hole and a second communication hole provided on an opposite side of the first communication hole with respect to the cylinder bank center line. Each of the first communication hole and the second communication hole communicates with the block opening and the head opening in an inter-bore region which separates adjacent cylinder bores. The head opening includes a first end and a second end provided on an opposite side of the first end with respect to the cylinder bank center line. The block opening includes a third end and a fourth end provided on an opposite side of the third end with respect to the cylinder bank center line. In a cross-section defined through the inter-bore region and perpendicular to the cylinder bank center line, the first end and the second end which face the cylinder bank center line are disposed nearer to the cylinder bank center line than the third end and the fourth end which face the cylinder bank center line, respectively. In the cross-section, a fifth end of the first communication hole facing the cylinder bank center line is disposed nearer to the cylinder bank center line than the third end and the fourth end of the block openings which face the cylinder bank center line. A top surface of the inter-bore region has a recessed groove. Both ends of the recessed groove are exposed from the first communication hole and the second communication hole which are provided on both sides of the cylinder bank center line.

According to further aspect of the present invention, a cooling structure of an internal combustion engine includes a cylinder block, a cylinder head, and a gasket. The cylinder block includes a block-side coolant passage which surrounds an entire circumference of the cylinder bores which are arranged along a cylinder bank center line in the internal combustion engine. The block-side coolant passage has a block opening which is open through a first surface of the cylinder block. The cylinder head includes a head-side coolant passage. The head-side coolant passage has a head opening which is open through a surface of the cylinder head. The second surface faces the cylinder block. The first surface faces the cylinder head. The gasket is provided between the cylinder block and the cylinder head. The gasket has a first communication hole and a second communication hole provided on an opposite side of the first communication hole with respect to the cylinder bank center line. Each of the first communication hole and the second communication hole communicating with the block opening and the head opening in an inter-bore region which separates adjacent cylinder bores. The head opening includes a first end and a second end provided on an opposite side of the first end with respect to the cylinder bank center line. The block opening includes a third end and a fourth end provided on an opposite side of the third end with respect to the cylinder bank center line. In a cross-section defined through the inter-bore region and perpendicular to the cylinder bank center line, the first end and the second end which face the cylinder bank center line are disposed nearer to the cylinder bank center line than the third end and the fourth end which face the cylinder bank center line, respectively. In the cross-section, a fifth end of the first communication hole facing the cylinder bank center line is disposed nearer to the cylinder bank center line than the third end and the fourth end of the block openings which face the cylinder bank center line. A top surface of the inter-bore region has a recessed groove. The recessed groove allows halves of the block-side coolant passage on both sides of the cylinder bank center line to communicate with each other.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

FIG. 6A illustrates an isoline map in the first embodiment, and FIG. 6B illustrates an isoline map in a comparative example.

DESCRIPTION OF THE EMBODIMENTS

Figure 1:
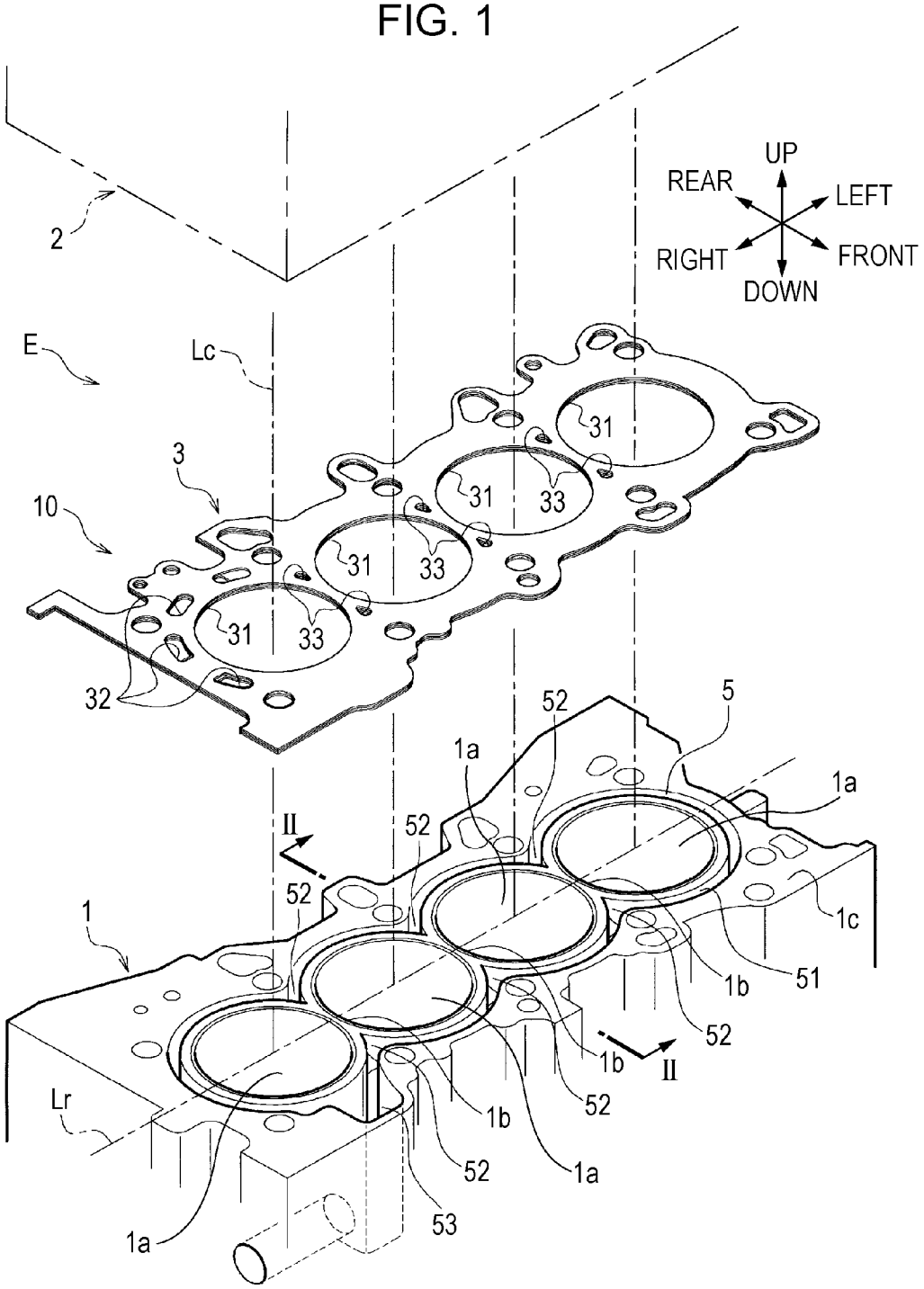
FIG. 1 is a perspective view of an internal combustion engine having a cooling structure of an internal combustion engine according to a first embodiment.

The embodiments will now be described with reference to the accompanying drawings, wherein like reference numerals designate corresponding or identical elements throughout the various drawings.

First Embodiment

A first embodiment of the present disclosure will be described in detail with reference to FIGS. 1 to 6. In the following description, the same elements are labeled with the same number and redundant description is omitted. As illustrated in each figure, a direction is described with respect to the front and rear, right and left, and up and down of a vehicle with an internal combustion engine E installed therein. It is to be noted that the up and down direction agrees with the direction of the cylinder axis.

Figure 2:
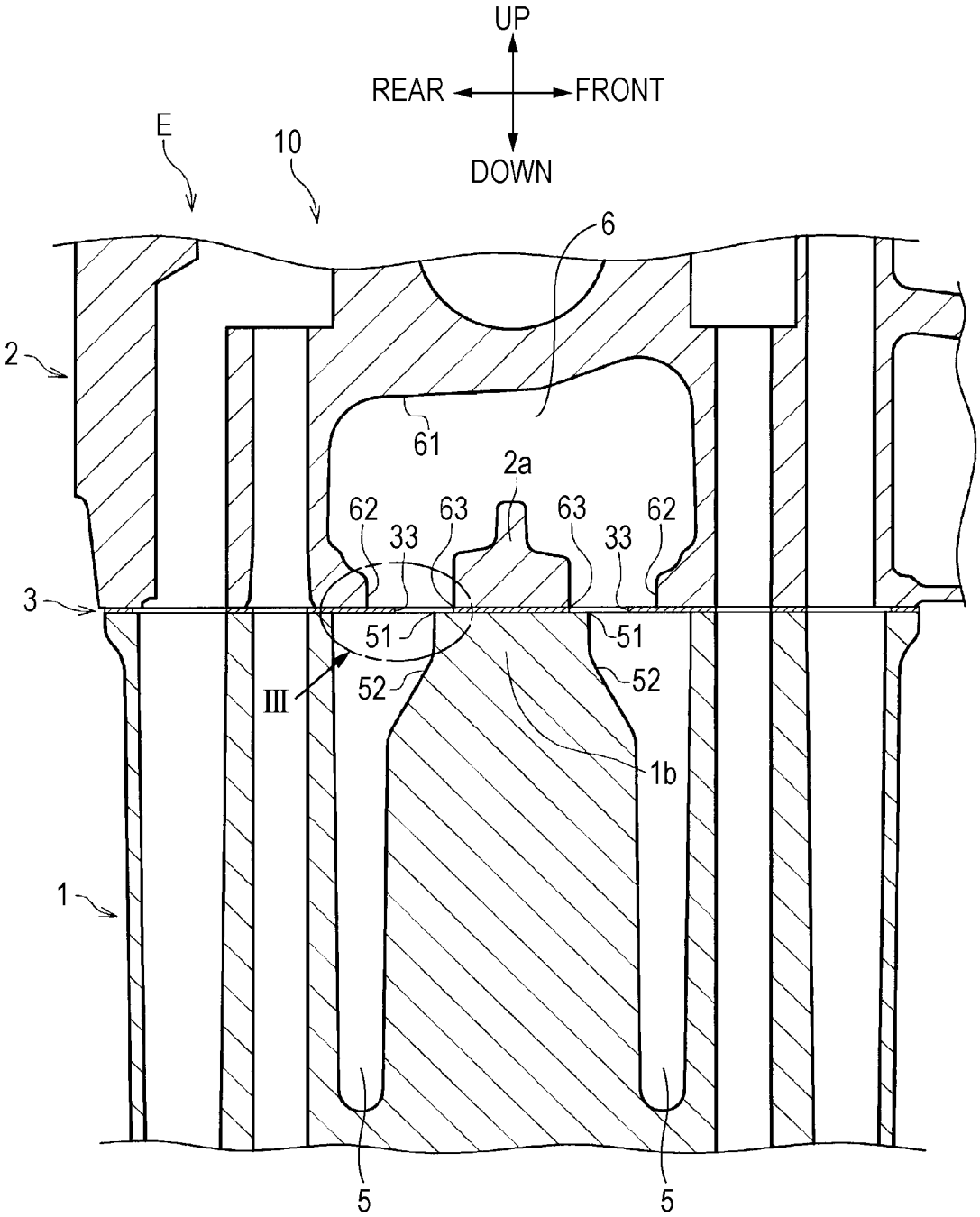
FIG. 2 is a cross-sectional view of the internal combustion engine, taken along line II-II of FIG. 1, the line II-II passing through an inter-bore region and perpendicular to a cylinder bank center line.

First, an internal combustion engine E according to the first embodiment will be described with reference to FIGS. 1 and 2. As illustrated in FIGS. 1 and 2, the internal combustion engine E has an engine main body including a cylinder block 1 which is integrally provided and in which four cylinder bores 1*a* are disposed in series, a cylinder head 2 connected to the upper end of the cylinder block 1, a gasket 3 disposed between the cylinder block 1 and the cylinder head 2, and a head cover (not illustrated) connected to the upper end of the cylinder head 2. Herein, the "cylinder bank center line Lr" is defined as the line that is perpendicular to the cylinder axes Lc of the cylinder bores 1*a* disposed in series and joins the cylinder axes Lc. The "cylinder bank perpendicular direction" is defined as the direction that is perpendicular to the cylinder axes Lc and the cylinder bank center line Lr.

Although detailed illustration is omitted, the internal combustion engine E is a multi-cylinder internal combustion engine which includes four cylinder bores 1*a*, pistons which fit in respective cylinder bores 1*a* in a reciprocatable manner, and a crankshaft which is connected to the pistons via respective connecting rods. The internal combustion engine E is mounted on a vehicle in a transverse manner with the rotational center axis of the crankshaft aligned in the right and left direction. The internal combustion engine E is disposed such that the intake air side faces in the rear direction of the vehicle and the exhaust side faces in the front direction of the vehicle. For each cylinder bore 1*a*, a combustion chamber is formed by the cylinder bore 1*a*, a piston, and the cylinder head 2 between the piston and the cylinder head 2 in the cylinder axis direction which is parallel to the cylinder axis Lc of the cylinder bore 1*a*. In the present embodiment, the internal combustion engine E is installed such that each cylinder axis Lc agrees with the vertical axis direction. The present disclosure, however, is not limited to this, and the internal combustion engine E may be installed such that each cylinder axis Lc is inclined with respect to the vertical axis direction, for example.

In such an internal combustion engine E, a cooling structure 10 of an internal combustion engine according to the first embodiment mainly includes the cylinder block 1, the cylinder head 2, the gasket 3, a block-side coolant passage 5 provided in the cylinder block 1, a head-side coolant passage 6 provided in the cylinder head 2, and a plurality of intermediate communication holes 33 provided in the gasket 3.

Figure 4:
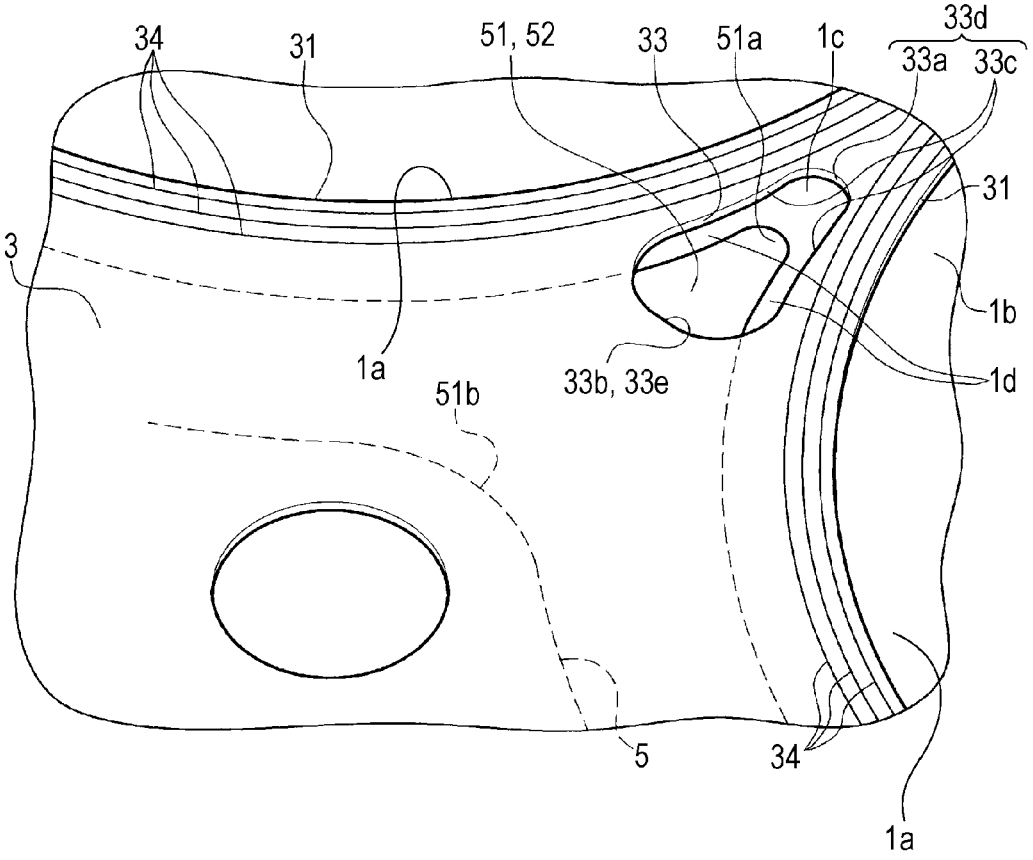
FIG. 4 is a perspective view of the inter-bore region and its periphery as seen in the direction of arrow Z of FIG. 3.
Figure 5:
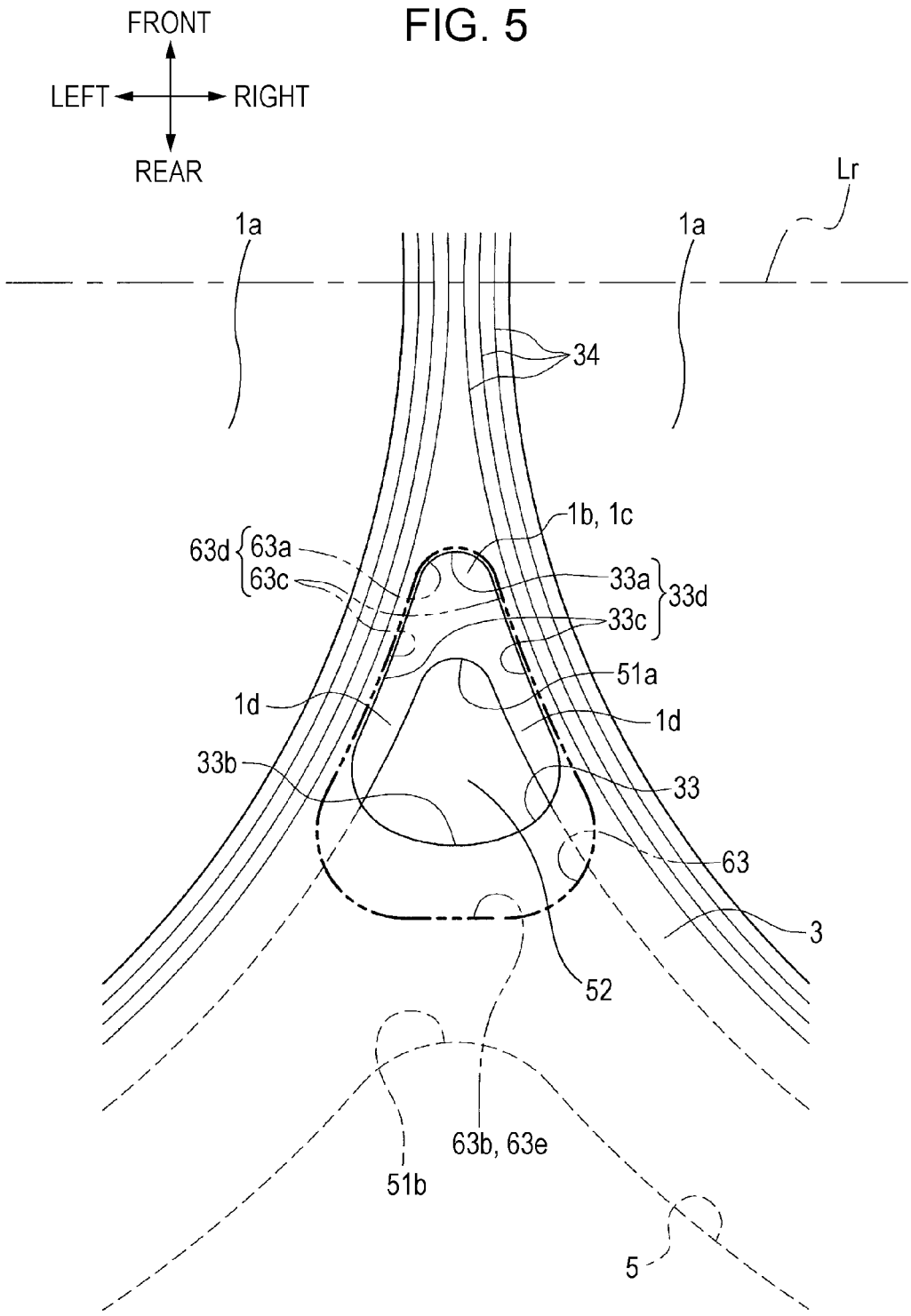
FIG. 5 is a plan view of the inter-bore region and its periphery.

As illustrated in FIGS. 1 and 2, the cylinder block 1 has a partition wall 1*b* which partitions adjacent cylinder bores 1*a*. The partition wall 1*b* is located at the mid-position of the cylinder axes Lc of adjacent cylinder bores 1*a*, and extends perpendicular to the above-described cylinder bank center line Lr. The vicinity of the upper end of the partition wall 1*b* has a width dimension in the cylinder bank perpendicular direction, the width dimension being narrowed by the below-described constricted portions 52. As illustrated in FIGS. 4 and 5, front and rear ends in the vicinity of the upper end of the partition wall 1*b* continuously extend to respective forked portions 1*d* which are each branched into two forks by the below-described constricted portions 52. The vicinity of the upper end of the partition wall 1*b* and the forked portions 1*d* constitute the "inter-bore region" in the claims. The cylinder block 1 has the block-side coolant passage 5 which surrounds the entire circumference of the four cylinder bores 1*a* and three partition walls 1*b*.

The block-side coolant passage 5 is an annular concave groove through which coolant flows for cooling the peripheral walls of the cylinder bores 1*a* and the partition walls 1*b*. The block-side coolant passage 5 is what is called an open deck coolant passage and has a block opening 51 which is mostly open through the top surface 1*c* of the cylinder block 1. The block-side coolant passage 5 has constricted portions 52, each of which is closer to the cylinder bank center line Lr and located at a position corresponding to a partition wall 1*b*. In addition, the block-side coolant passage 5 has an inflow portion 53 for the coolant on the front right side of the cylinder block 1. A partition member (not illustrated) is installed on the right of the inflow portion 53. Consequently, the coolant, which flows in the block-side coolant passage 5 through the inflow portion 53, flows from the right to the left on the front side of the cylinder block 1, then makes U-turn at the left end, and flows from the left to the right on the rear side of the cylinder block 1 to reach the right end of the cylinder block 1.

As illustrated in FIGS. 1 and 2, the gasket 3 is a member which is interposed between the cylinder block 1 and the cylinder head 2 to prevent leakage of a combustion gas and the coolant. The gasket 3 in the present embodiment is formed by stacking, for example, three metal plates. The gasket 3 has a bore opening 31 corresponding to each cylinder bore 1*a*, and a plurality of main communication holes 32 and intermediate communication holes 33 which communicate with the block-side coolant passage 5 and the head-side coolant passage 6. The plurality of main communication holes 32 are provided above the right end of the block-side coolant passage 5. The plurality of intermediate communication holes 33 are provided above the constricted portions 52 of the block-side coolant passage 5. The area of each main communication hole 32 is greater than the area of each intermediate communication hole 33.

As illustrated in FIG. 2, the cylinder head 2 is a member which is securely fixed to the upper part of the cylinder block 1 via the gasket 3, and has an intake and exhaust passage to each combustion chamber and a valve mechanism (not illustrated). In addition, the cylinder head 2 has the head-side coolant passage 6 for cooling the combustion chambers and the intake and exhaust passages. Furthermore, the cylinder head 2 has a combustion chamber periphery 2*a* which separates adjacent combustion chambers. The combustion chamber periphery 2*a* has a convex shaped cross-sectional view perpendicular to the cylinder bank center line Lr.

The head-side coolant passage 6 is a tubular space through which coolant flows for cooling the combustion chambers and the intake and exhaust passages. As illustrated in FIG. 2, the head-side coolant passage 6 mainly has a main passage portion 61 which is continuous in the right and left direction (sheet surface orthogonal direction of FIG. 2) inside the cylinder head 2, and a plurality of intermediate inflow portions 62 which allow the lower surface of the cylinder head 2 and the main passage portion 61 to be communicated with each other in the up and down direction.

As illustrated in FIG. 2, the intermediate inflow portions 62 are provided as pairs at the positions on both front and rear sides corresponding to the partition walls 1*b* of the cylinder block 1 (in other words, at the positions corresponding to the constricted portions 52 of the block-side coolant passage 5), and communicate with the constricted portions 52 of the block-side coolant passage 5 through the intermediate communication holes 33 of the gasket 3. The intermediate inflow portions 62 each have a head opening 63 which is open through the lower surface of the cylinder head 2. Above the main communication holes 32 (see FIG. 1) of the gasket 3, the cylinder head 2 has a plurality of main inflow portions (not illustrated) which allow the main communication holes 32 and the right end of the main passage portion 61 (see FIG. 2) to be communicated with each other.

In the following, how the coolant generally flows will be described. The coolant, which has reaches the right end of the above-described block-side coolant passage 5, flows in the right end of the main passage portion 61 through the main communication holes 32 and the main inflow portions (not illustrated), and flows through the main passage portion 61 from the right to the left. Part of the coolant, which flows through the constricted portions 52 of the block-side coolant passage 5, flows in the intermediate inflow portions 62 through the intermediate communication holes 33, then merges with the coolant which flows through the main passage portion 61 from the right to the left. In this manner, what is called a longitudinal coolant flow passage is formed. It is to be noted that the ratio of the amount of the coolant that passes through the main communication holes 32 and the main inflow portions (not illustrated) with respect to the amount of the coolant that passes through the intermediate communication holes 33 and the intermediate inflow portions 62 is not particularly limited, and may be set to 7:3, for example.

Figure 3:
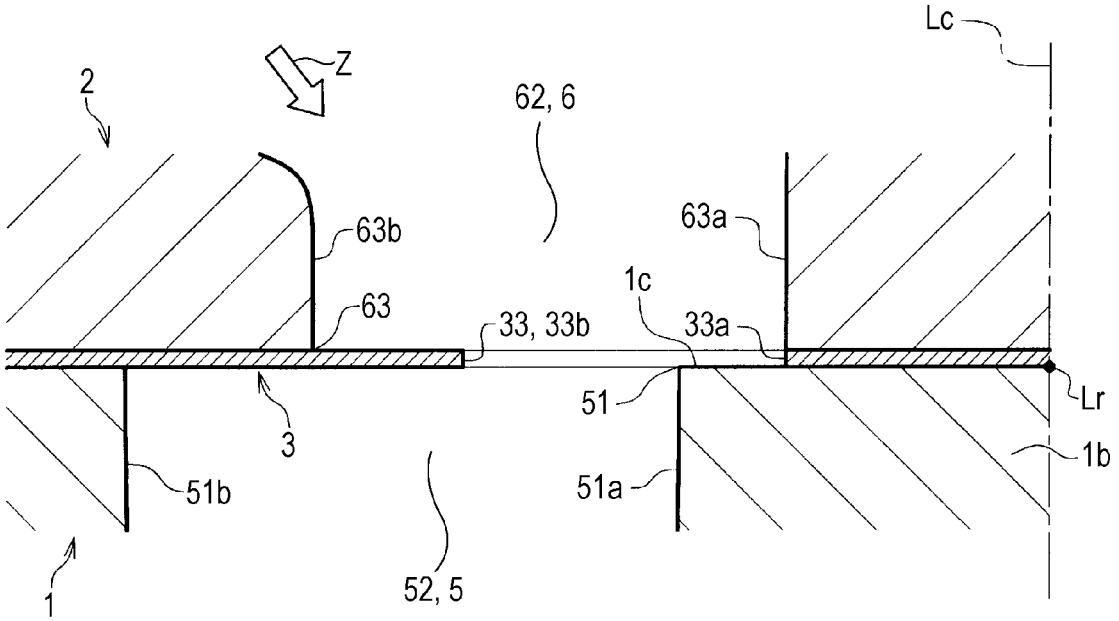
FIG. 3 is an expanded cross-sectional view of portion III illustrated in FIG. 2.

In the following, the structure of the block opening 51, the intermediate communication hole 33, and the head opening 63 in a cross-section perpendicular to the cylinder bank center line Lr and through a partition wall 1*b* which is part of an inter-bore region will be described in detail with reference to FIGS. 3, 4 and 5. Because the structure is symmetrical in the front and rear direction with respect to the cylinder bank center line Lr, only the structure of the rear side illustrated in FIG. 3 will be described, and a description of the structure of the front side is omitted. FIG. 3 is an expanded cross-sectional view of portion III illustrated in FIG. 2. FIG. 4 is a perspective view of the inter-bore region and its periphery as seen in the direction of arrow Z of FIG. 3. FIG. 5 is a plan view of the inter-bore region and its periphery. In FIG. 4, the cylinder head 2 is not illustrated. In FIG. 5, the head opening is illustrated by an imaginary line (two-dot chain line).

As illustrated by an imaginary line in FIG. 5, the head opening 63 which is open through the bottom surface of the cylinder head 2 is formed in a tapered shape such that the width of the head opening 63 in the direction of the cylinder bank center line Lr is narrower toward the cylinder bank center line Lr. In other words, the head opening 63 is formed in an approximately isosceles triangular shape (or a pear shape) with the rounded vertex, and has a vertex portion 63*a* facing the cylinder bank center line Lr, a base portion 63*b* on the opposite side to the vertex portion 63*a*, and two side portions 63*c*, 63*c* which connect between the vertex portion 63*a* and both ends of the base portion 63*b*. The vertex portion 63*a* is curved in an arc shape convex toward the outside of the head opening 63. The central part of the base portion 63*b* extends in the right and left direction along the cylinder bank center line Lr, and the both ends of the base portion 63*b* are curved so as to be smoothly connected to the side portions 63*c*. The two side portions 63*c*, 63*c* have a narrower width therebetween toward the cylinder bank center line Lr, and have the narrowest width at the vertex portion 63*a*. The two side portions 63*c* are curved in an arc shape convex toward the inside of the head opening 63 along the peripheral walls of the cylinder bores 1*a*. Between those portions, the vertex portion 63*a* and the two side portions 63*c*, 63*c* constitute an end 63*d* (hereinafter simply referred to as an "inner end 63*d*") of the head opening 63, that faces the cylinder bank center line Lr. The base portion 63*b* constitutes an end 63*e* (hereinafter simply referred to as an "outer end 63*e*") of the head opening 63, that is opposite to the cylinder bank center line Lr.

As illustrated in FIGS. 3, 4 and 5, in a cross-section through the inter-bore region and perpendicular to the cylinder bank center line Lr, the inner ends 63*d* of a pair of head openings 63 provided on opposite sides with respect to the cylinder bank center line Lr are disposed nearer to the cylinder bank center line Lr than ends 51*a* (hereinafter each simply referred to "inner end 51*a*") of a pair of block openings 51 provided on the opposite sides with respect to the cylinder bank center line Lr, the ends 51*a* facing the cylinder bank center line Lr. That is, the inner end 63*d* of each head opening 63 is offset toward the cylinder bank center line Lr with respect to the inner end 51*a* of each block opening 51.

As illustrated in FIGS. 4 and 5 (mainly FIG. 5), the intermediate communication hole 33 is formed in a tapered shape such that the width thereof in the direction of the cylinder bank center line Lr is narrower toward the cylinder bank center line Lr. In other words, the intermediate communication hole 33 is, for example, approximately similar to the head opening 63 and is formed in an approximately isosceles triangular shape (or a pear shape) with the rounded vertex, and has a vertex portion 33*a* facing the cylinder bank center line Lr, a base portion 33*b* which is opposed to the vertex portion 33*a*, and two side portions 33*c*, 33*c* which connect between the vertex portion 33*a* and both ends of the base portion 33*b*. The vertex portion 33*a* is curved in an arc shape convex toward the outside of the intermediate communication hole 33. The base portion 33*b* has almost no linear portion, and is curved in an arc shape convex toward the outside of the intermediate communication hole 33 so as to connect the side portions 33*c*. The two side portions 33*c*, 33*c* have a narrower width therebetween toward the cylinder bank center line Lr, and have the narrowest width at the vertex portion 33*a*. The two side portions 33*c*, 33*c* are curved in an arc shape convex toward the inside of the intermediate communication hole 33 along the below-described beads 34 (having a predetermined space with respect to the beads 34). Between those portions, the vertex portion 33*a* and the two side portions 33*c*, 33*c* constitute an end 33*d* (hereinafter simply referred to as an "inner end 33*d*") of the intermediate communication hole 33, that faces the cylinder bank center line Lr. The base portion 33*b* constitutes an end 33*e* (hereinafter simply referred to as an "outer end 33*e*") of the intermediate communication hole 33, that is opposite to the cylinder bank center line Lr.

As illustrated in FIG. 4, the casket 3 has three beads 34 which each serve as a seal line for surrounding the circumference of the bore opening 31. The beads 34 are formed concentrically with the cylinder bores 1*a*. In a range not interfering with the outermost bead 34, the inner end 33*d* of the intermediate communication hole 33 is provided at a position near the cylinder bank center line Lr as much as possible.

As illustrated in FIGS. 3, 4 and 5, the inner ends 33*d* of a pair of the intermediate communication holes 33 provided on opposite sides with respect to the cylinder bank center line Lr are disposed between the inner ends 51*a* of a pair of the block openings 51 and the inner ends 63*d* of the head openings 63 (the same position as the inner end 63*d* of the head opening 63 in the present embodiment). That is, the inner end 33*d* of each intermediate communication hole 33 is offset toward the cylinder bank center line Lr with respect to the inner end 51*a* of each block opening 51.

As a consequence of adopting such a configuration, elements (that is, the inner end 63*d* of the head opening 63 and the inner end 33*d* of the intermediate communication hole 33) that causes the flow velocity of the coolant to be reduced are not present immediately above the inner end 51*a* of the block opening 51 as illustrated in FIG. 3. As illustrated in FIGS. 4 and 5, part of the top surface 1*c* of the cylinder block 1 (more specifically, the partition wall 1*b* and part of the top surface of the forked portions 1*d*) is exposed from the intermediate communication hole 33.

The outer end 33*e* of the intermediate communication hole 33 is disposed nearer to the cylinder bank center line Lr than the inner end 51*a* of the block opening 51. By adjusting the space between the outer end 33*e* of the intermediate communication hole 33 and the inner end 51*a* of the block opening 51, the flow velocity of the coolant which passes through therebetween may be controlled. The outer end 63*e* of the head opening 63 is provided between the outer end 51*b* of the block opening 51 and the outer end 33*e* of the intermediate communication hole 33.

The cooling structure 10 of an internal combustion engine according to the first embodiment is basically constructed in the above manner. In the following, the operational effect of the cooling structure 10 of an internal combustion engine will be described in detail with reference to FIGS. 6A and 6B.

Figure 6B:
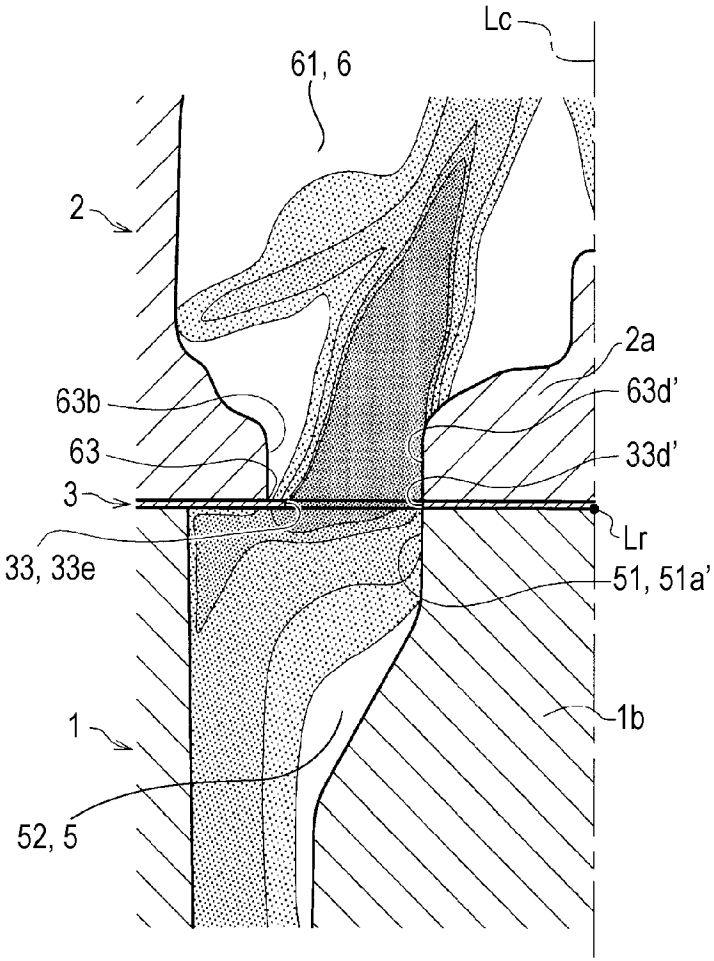
FIGS. 6A and 6B are each an isoline map of the flow velocity of coolant in a cross-section passing through a partition wall and perpendicular to the cylinder bank center line.
Figure 6A:
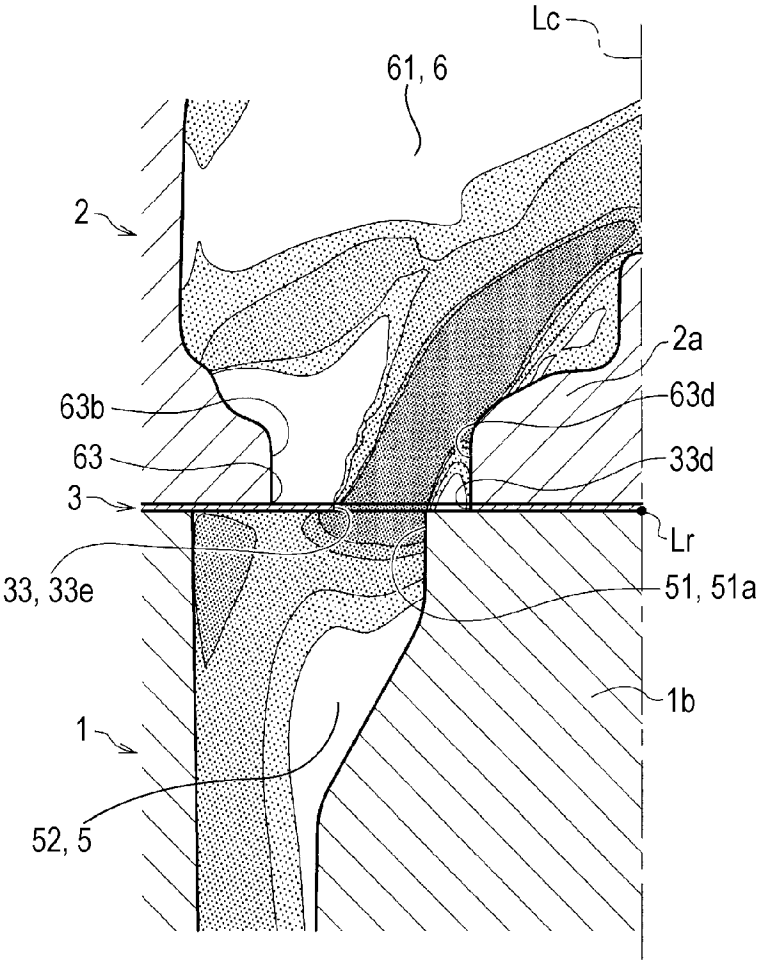

FIGS. 6A and 6B are each an isoline map of the flow velocity of coolant in a cross-section passing through a partition wall and perpendicular to the cylinder bank center line, FIG. 6A illustrates an isoline map in the first embodiment, and FIG. 6B illustrates an isoline map in a comparative example. The isoline map illustrates a result of three-dimensional simulation analysis by a computer under the same conditions except for the shape of the coolant passage (for example, the flow of fluid, the initial flow velocity, specific gravity, viscosity, etc.) in the vicinity of the partition wall 1*b*, and a portion in a darker color indicates that the portion has a faster coolant flow velocity. Because the flow velocity of coolant and the heat transfer coefficient have a proportional relationship, a portion with a faster coolant flow velocity indicates that the portion has a higher heat transfer coefficient (higher cooling efficiency).

First, in the embodiment illustrated in FIG. 6A, the inner end 63*d* of the head opening 63 and the inner end 33*d* of the intermediate communication hole 33 are offset toward the cylinder bank center line Lr with respect to the inner end 51*a* of the block opening 51. Referring to the analysis result under this condition, an isoline with a darker color is in contact with the inner end 51*a* of the block opening 51. It is seen from this that the coolant, which is in contact with the inner end 51*a* of the block opening 51, has a higher flow velocity, and thus the end 51*a*, which is part of the lateral surface of the partition wall 1*b*, has a higher heat transfer coefficient (is likely to be cooled).

On the other hand, in the comparative example illustrated in FIG. 6B, an inner end 63*d*' of the head opening 63 and an inner end 33*d*' of the intermediate communication hole 33 are located immediately above an inner end 51*a*' of the block opening 51. Referring to the analysis result under this condition, an isoline with a lighter color than in the above-described embodiment is in contact with the inner end 51*a*' of the block opening 51. It is seen from this that the coolant, which is in contact with the inner end 51*a*' of the block opening 51, has a lower coolant flow velocity than in the embodiment illustrated in FIG. 6A, and thus the end 51*a*' portion has a lower heat transfer coefficient than in the embodiment illustrated in FIG. 6A (not likely to be cooled).

This is because, in the comparative example of FIG. 6B, the wall surface of the inner end 63*d*' of the head opening 63 and the inner end 33*d*' of the intermediate communication hole 33 disposed immediately above the inner end 51*a*' of the block opening 51 probably serves as a resistance to the coolant, and the flow velocity of the coolant near the inner end 51*a*' of the block opening 51 is thereby reduced.

The cylinder block 1, the cylinder head 2, and the gasket 3 are aligned using a knock-pin and a locating hole (not illustrated), however, a very small misalignment may occur due to a dimensional error of a mold or deviation at the time of molding process. Although detailed illustration is omitted, it was found that for example when the inner end 33*d*' of the intermediate communication hole 33 projects more than the inner end 51*a*' of the block opening 51 by even a slight degree due to the very small misalignment, the flow velocity of the coolant near the inner end 51*a*' of the block opening 51 is significantly reduced.

On the other hand, in the embodiment of FIG. 6A, the inner end 63*d* of the head opening 63 and the inner end 33*d* of the intermediate communication hole 33 are not present as resistance to the coolant immediately above the inner end 51*a* of the block opening 51. Therefore, above the inner end 51*a* of the block opening 51, decrease in the flow velocity of coolant is reduced, the coolant flowing in the head-side coolant passage 6. Consequently, decrease in the coolant flow velocity is also reduced at the inner end 51*a* of the block opening 51, and the efficiency in cooling the partition wall 1*b* is improved.

Even when a very small misalignment occurs due to an error at the time of manufacture or assembly of the internal combustion engine E, there is almost no possibility that the inner end 33*d* of the intermediate communication hole 33 is located outwardly (on the side opposite to the cylinder bank center line Lr) of the inner end 51*a* of the block opening 51, and thus it is possible to prevent reduction in flow velocity near the end 51*a* due to manufacturing error.

In the embodiment of FIG. 6A, the top surface 1*c* of the partition wall 1*b* (see FIGS. 4 and 5) is exposed and the flow velocity is relatively low. However, the coolant is in direct contact with the top surface 1*c*, and thus in contrast to the comparative example of FIG. 6B, the efficiency in cooling the partition wall 1*b* is improved.

In the embodiment of FIG. 6A, the inner end 63*d* of the head opening 63 and the inner end 33*d* of the intermediate communication hole 33 are offset toward the cylinder bank center line Lr with respect to the inner end 51*a* of the block opening 51, and thus the coolant, which flows out through the block opening 51 and flows in the head-side coolant passage 6 through the intermediate communication hole 33 of the gasket 3 and the head opening 63, passes through in the direction toward the cylinder bank center line Lr (that is, in the direction toward the combustion chamber periphery 2*a*). Consequently, a portion with a faster coolant flow velocity (a portion with dark isoline color) is located to be closer to the combustion chamber periphery 2*a*, and thus the efficiency in cooling the combustion chamber periphery 2*a* is improved.

As illustrated in FIG. 4, the intermediate communication hole 33 is formed in a tapered shape such that the width thereof in the direction of the cylinder bank center line Lr is narrower toward the cylinder bank center line Lr, and thus in a range not interfering with the seal lines of the cylinder bores 1*a* (beads 34), the inner end 33*d* of the intermediate communication hole 33 may be located near the cylinder bank center line Lr as much as possible. Consequently, the efficiency in cooling the partition wall 1*b* and the forked portions 1*d* may be improved by increasing the exposed range of the partition wall 1*b* and the top surface 1*c* of the forked portions 1*d*.

According to the analysis of the inventors, it has been found that when the ratio (B/A) of area (B) of the top surfaces 1*c*, 1*d* of the cylinder block 1 exposed from the intermediate communication hole 33 with respect to area (A) of the intermediate communication hole 33 is 0.24 or greater and 0.82 or less, the heat transfer coefficient of the lateral surface (the inner wall surface of the constricted portion 52) of the partition wall 1*b* is approximately 12000 $W/m^2 \cdot K$ or greater, and thus the inter-bore region may be effectively cooled.

Second Embodiment

Figure 7:
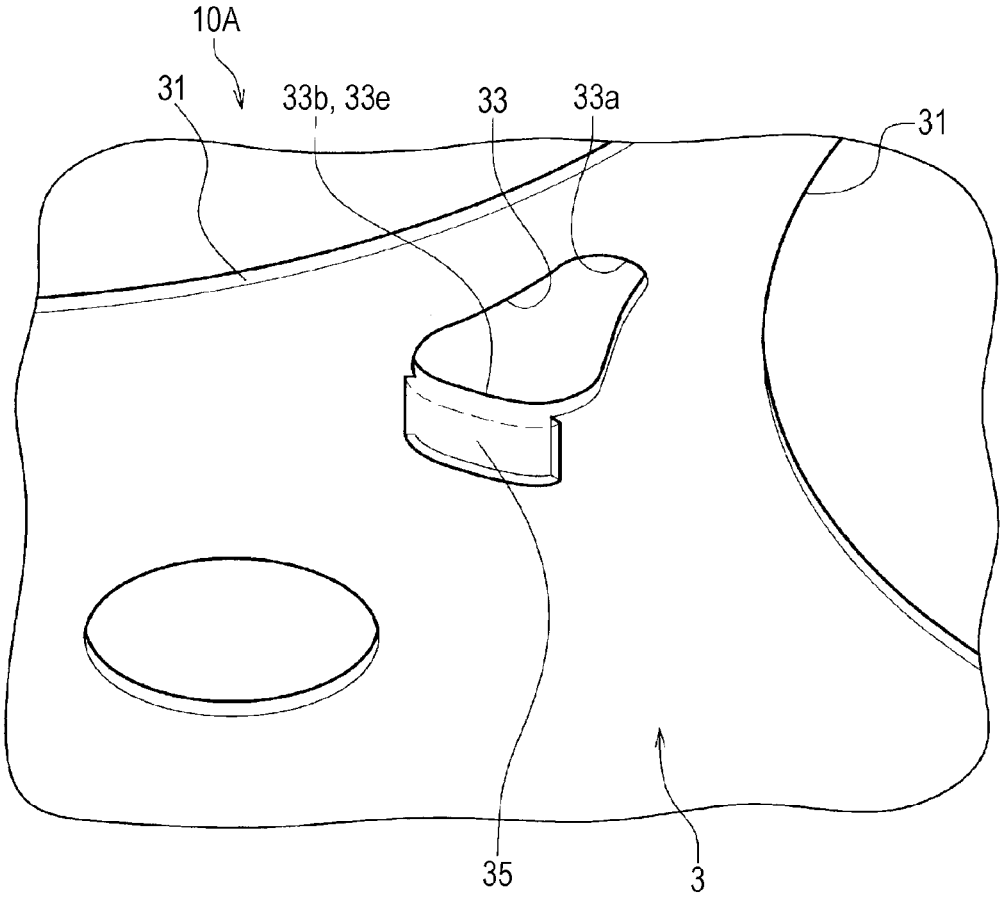
FIG. 7 is a perspective view from a lower side of an intermediate communication hole of a gasket in a second embodiment.
Figure 8:
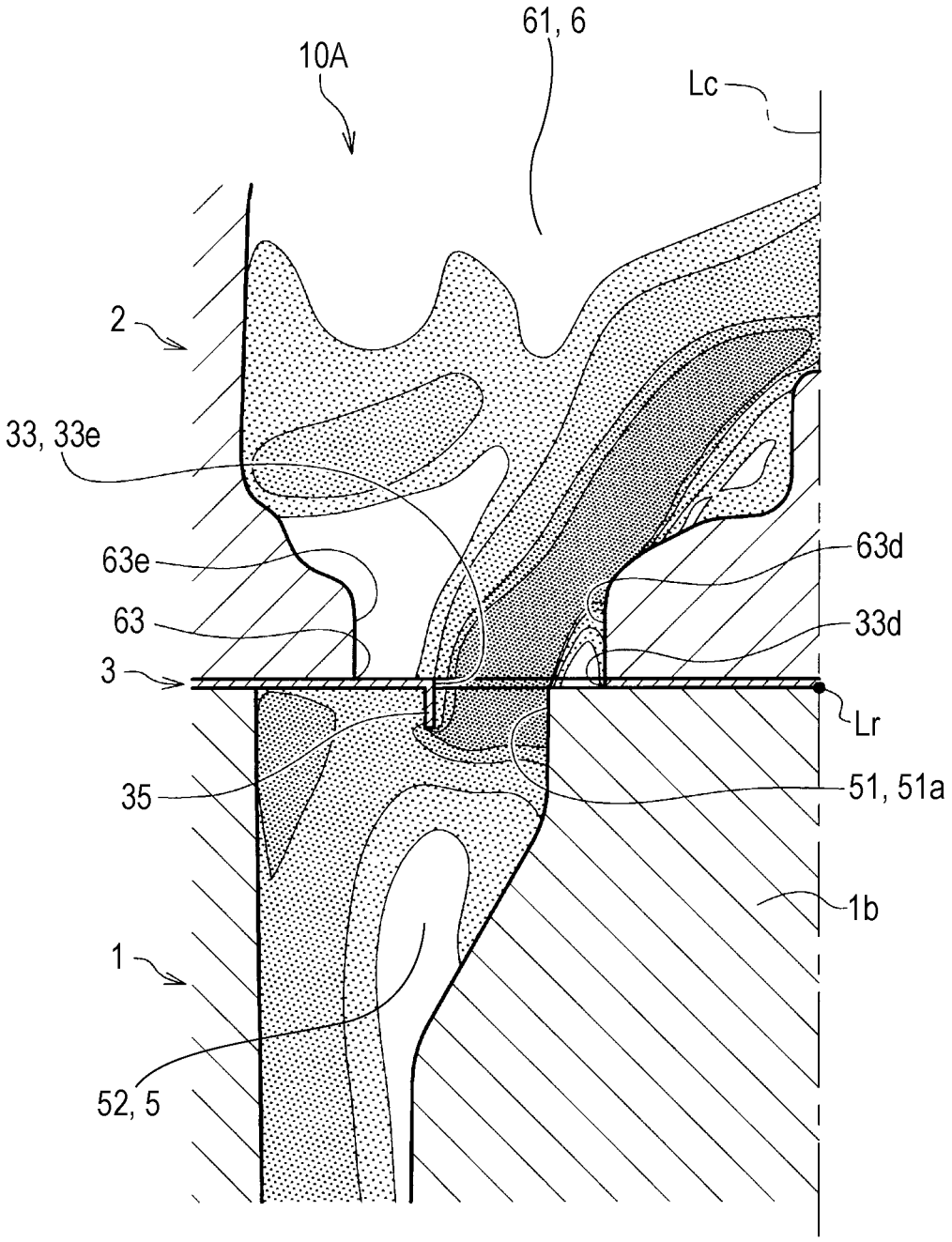
FIG. 8 is an isoline map of the flow velocity of coolant in a cross-section passing through the partition wall and perpendicular to the cylinder bank center line in the second embodiment.

Next, a cooling structure 10A of an internal combustion engine according to a second embodiment will be described in detail with reference to FIGS. 7 and 8. In the second embodiment, the same element as in the first embodiment is labeled with the same symbol and redundant description is omitted. FIG. 7 is a perspective view from a lower side of an intermediate communication hole of a gasket in the second embodiment. FIG. 8 is an isoline map of the flow velocity of coolant in a cross-section passing through a partition wall and perpendicular to the cylinder bank center line in the second embodiment.

The cooling structure 10A of an internal combustion engine according to the second embodiment differs from the cooling structure in the first embodiment in that the outer end 33*e* of the intermediate communication hole 33 of the gasket 3 includes an extending portion 35 as illustrated in FIG. 7.

The extending portion 35 is a wall-shaped portion which extends downward from the outer end 33*e* of the intermediate communication hole 33 toward the block-side coolant passage 5. The extending portion 35 is provided in the outer end 33*e* in a range not interfering with the cylinder block 1. That is, both ends of the extending portion 35 in the right and left direction are spaced apart from the inner wall surface of the block-side coolant passage 5. The extending portion 35 has a function of reducing the flow velocity near the outer end 33*e* of the intermediate communication hole 33. The method of forming the extending portion 35 is not particularly limited, and the extending portion 35 may be formed by bending simultaneously with die-cutting of the intermediate communication hole 33 at the time of press molding of the gasket 3, for example.

As illustrated in FIG. 8, providing the extending portion 35 causes the flow velocity of the coolant near the extending portion 35 to be reduced. Consequently, in a cross-section through the partition wall 1*b* and perpendicular to the cylinder bank center line Lr, a portion with a faster coolant flow velocity (a portion with dark isoline color) is located further closer to the cylinder bank center line Lr compared with FIG. 6A. This is because the extending portion 35 interferes with the flow of the coolant from the block-side coolant passage 5 to the head-side coolant passage 6, and thus the coolant flows around the extending portion 35 and flows at a further increased speed through the vicinity of the inter-bore region. Consequently, a portion with a faster coolant flow velocity (a portion with dark isoline color) is located further closer to the combustion chamber periphery 2*a*, and thus the efficiency in cooling the combustion chamber periphery 2*a* is further improved. In addition, the flow velocity of the coolant along the inner end 51*a* of the block opening 51 is increased, and the efficiency in cooling the partition wall 1*b* is further improved.

So far, the cooling structures 10, 10A of an internal combustion engine according to the present embodiments have been described with reference to the drawings. The present disclosure, however, is not limited to these embodiments, and may be modified as needed within a range without departing from the spirit of the present disclosure.

For example, in the present embodiment, in a cross-section through the partition wall 1*b* (inter-bore region) and perpendicular to the cylinder bank center line Lr, the inner wall surface of the constricted portion 52 is formed in a vertical face in the periphery of its upper end near the inner end 51*a* of the block opening 51, and is formed by bending so as to be linearly inclined under the vertical face (see FIG. 2). However, the present disclosure is not limited to this. For example, the inner wall surface of the constricted portion 52 may be formed as an inclined surface in a linear manner or a smoothly curved manner from the base or an intermediate portion of the block-side coolant passage 5 to the inner end 51*a* of the block opening 51. In this manner, the velocity of the coolant flowing upward along the inner wall surface of the constricted portion 52 is increased and the cooling efficiency is improved.

Figure 9A:
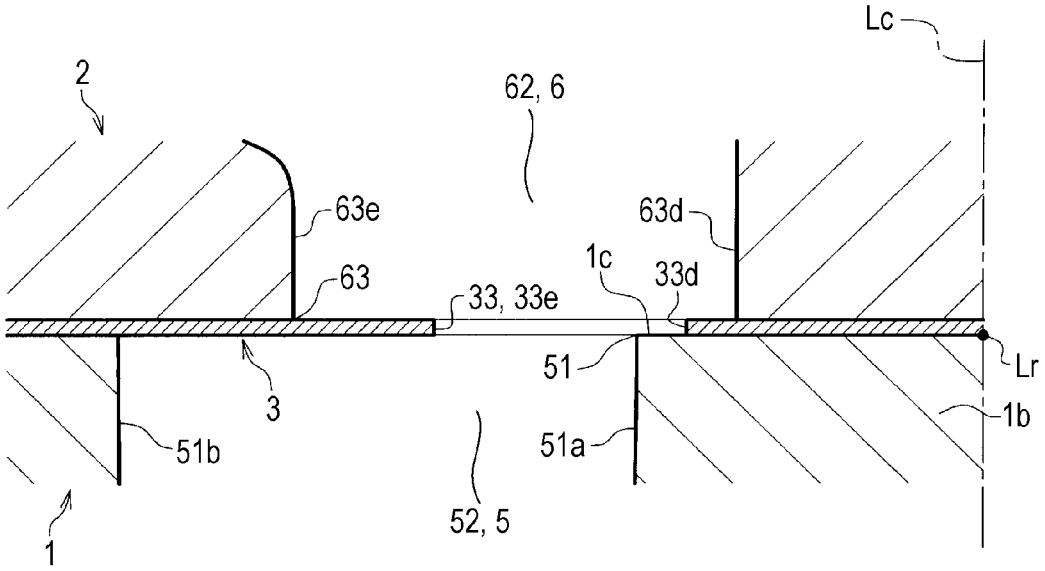
FIG. 9A is an expanded cross-sectional view illustrating a modification in which the position of an end of the intermediate communication hole is changed, the end facing the cylinder bank center line.

In the first embodiment, the inner end 33*d* of the intermediate communication hole 33 is provided at the same position as the inner end 63*d* of the head opening 63. However, the present disclosure is not limited to this. For example, as illustrated in FIG. 9A, the inner end 33*d* of the intermediate communication hole 33 may be provided between the inner end 51*a* of the block opening 51 and the inner end 63*d* of the head opening 63 (at the center between the two in FIG. 9A). Even in this case, in contrast to the comparative example illustrated in FIG. 6B, the top surface 1*c* of the partition wall 1*b* may be efficiently cooled by the coolant.

Figure 9B:
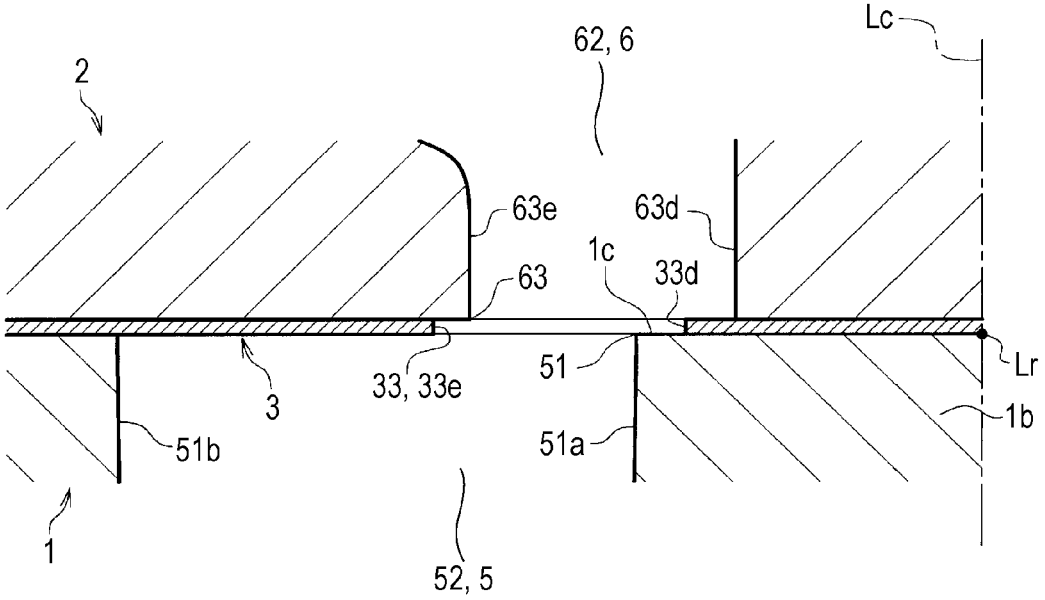
FIG. 9B is an expanded cross-sectional view illustrating a modification in which the position of an end of the intermediate communication hole is changed, the end being opposite to the cylinder bank center line.

As illustrated in FIG. 9B, the outer end 63*e* of the head opening 63 may project toward the cylinder bank center line Lr more than the outer end 33*e* of the intermediate communication hole 33. With this configuration, a portion with a faster coolant flow velocity (dark colored portion illustrated in FIG. 6A and FIG. 8) may be located further closer to the cylinder bank center line Lr.

In the first embodiment, the plurality of intermediate communication holes 33 has the same opening area. However, the present disclosure is not limited to this. For example, the intermediate communication hole 33 corresponding to more upstream of the block-side coolant passage 5 may have a smaller opening area. In this manner, substantially uniform cooling performance is achieved, and thus a variation in cooling performance between the upstream and downstream sides may be reduced.

In the first embodiment, the intermediate communication hole 33 is formed in a tapered shape such that the width thereof in the direction of the cylinder bank center line Lr is narrower toward the cylinder bank center line Lr as illustrated in FIG. 4. However, the present disclosure is not limited to this, and the intermediate communication hole 33 may be formed in a modified shape as needed. For example, the intermediate communication hole 33 may be formed in a circular shape. However, with the intermediate communication hole 33 being tapered as illustrated in FIG. 4, the inner end 33*d* of the intermediate communication hole 33 may be located further closer to the cylinder bank center line Lr in the partition wall 1*b*, and thus a significant cooling effect may be obtained.

The first embodiment has been described using an inline-four internal combustion engine as an example. However, the present disclosure is not limited to this and may be applied to an internal combustion engine having another arrangement form or different number of cylinders (for example, V-type six-cylinder engine) as long as the internal combustion engine has a portion where the cylinder bores 1*a* are arranged in series.

In the first embodiment, the coolant flows in through the inflow portion 53 provided on the front right in the block-side coolant passage 5, and flows counterclockwise around the entire circumference of four cylinder bores 1*a* as a plan view, and flows out from the right end of the block-side coolant passage 5 into the head-side coolant passage 6. However, the present disclosure is not limited to this. For example, when described with reference to FIG. 1, the coolant, which flows through the inflow portion 53 provided on the front right side, may be divided into two streams, and flows from the right to the left on the front side and rear side of the cylinder block 1, then flows out from the rear left side of the block-side coolant passage 5 to the head-side coolant passage 6.

Third Embodiment

Hereinafter, a third embodiment of the present disclosure will be described in detail with reference to FIGS. 10 to 12. In the following description, elements in common with those in the above-described embodiments are labeled with the same symbols, and redundant description will be omitted. A cooling structure 10A of an internal combustion engine according to the third embodiment differs from the above-described other embodiments in that the top surface 1*c* of the inter-bore region (the top surface of the partition wall 1*b*) has the recessed groove 7.

Figure 10:
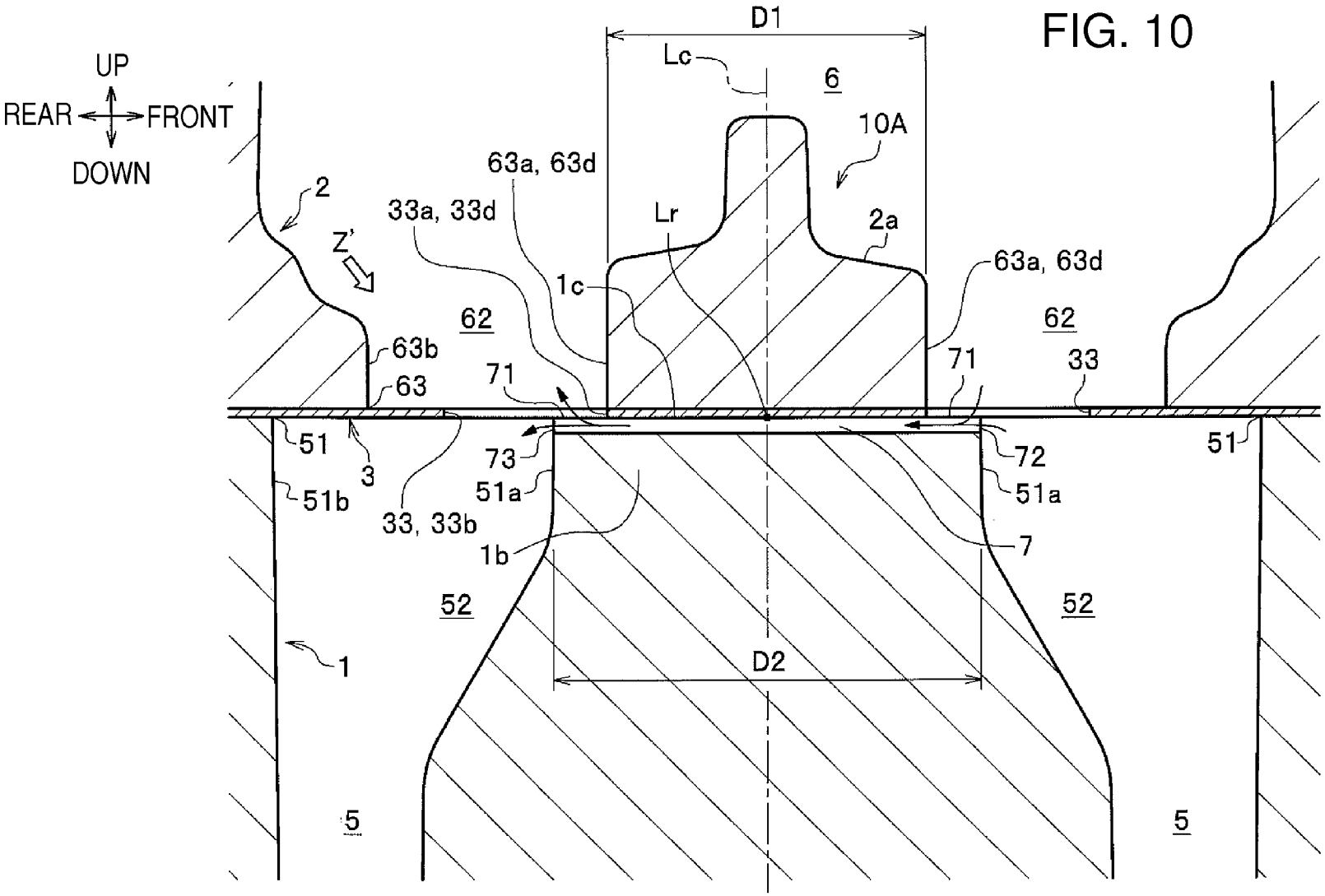
FIG. 10 is an enlarged partial cross-sectional view taken along the same position as line II-II of FIG. 1 in a cooling structure of an internal combustion engine according to a third embodiment.
Figure 11:
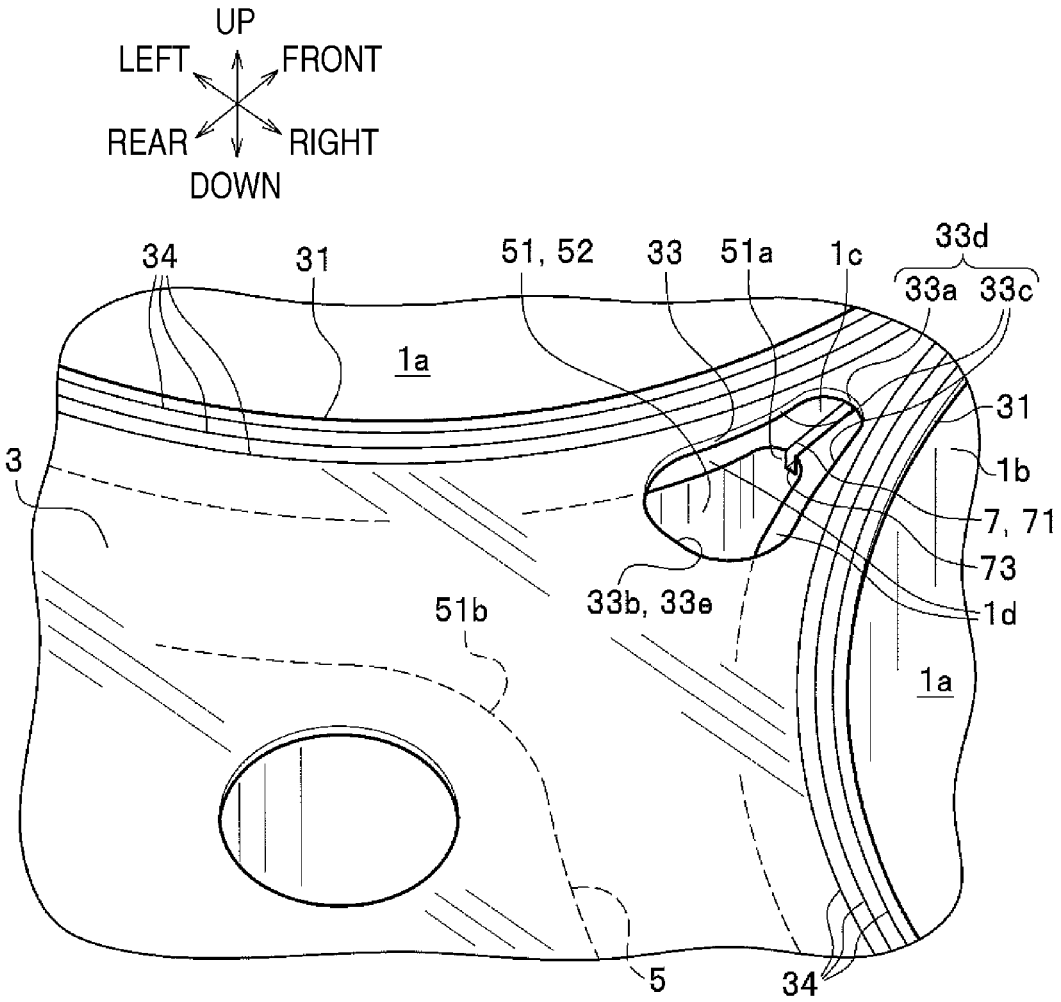
FIG. 11 is a perspective view of the inter-bore region and its periphery as seen in the direction of arrow Z' of FIG. 10.
Figure 12:
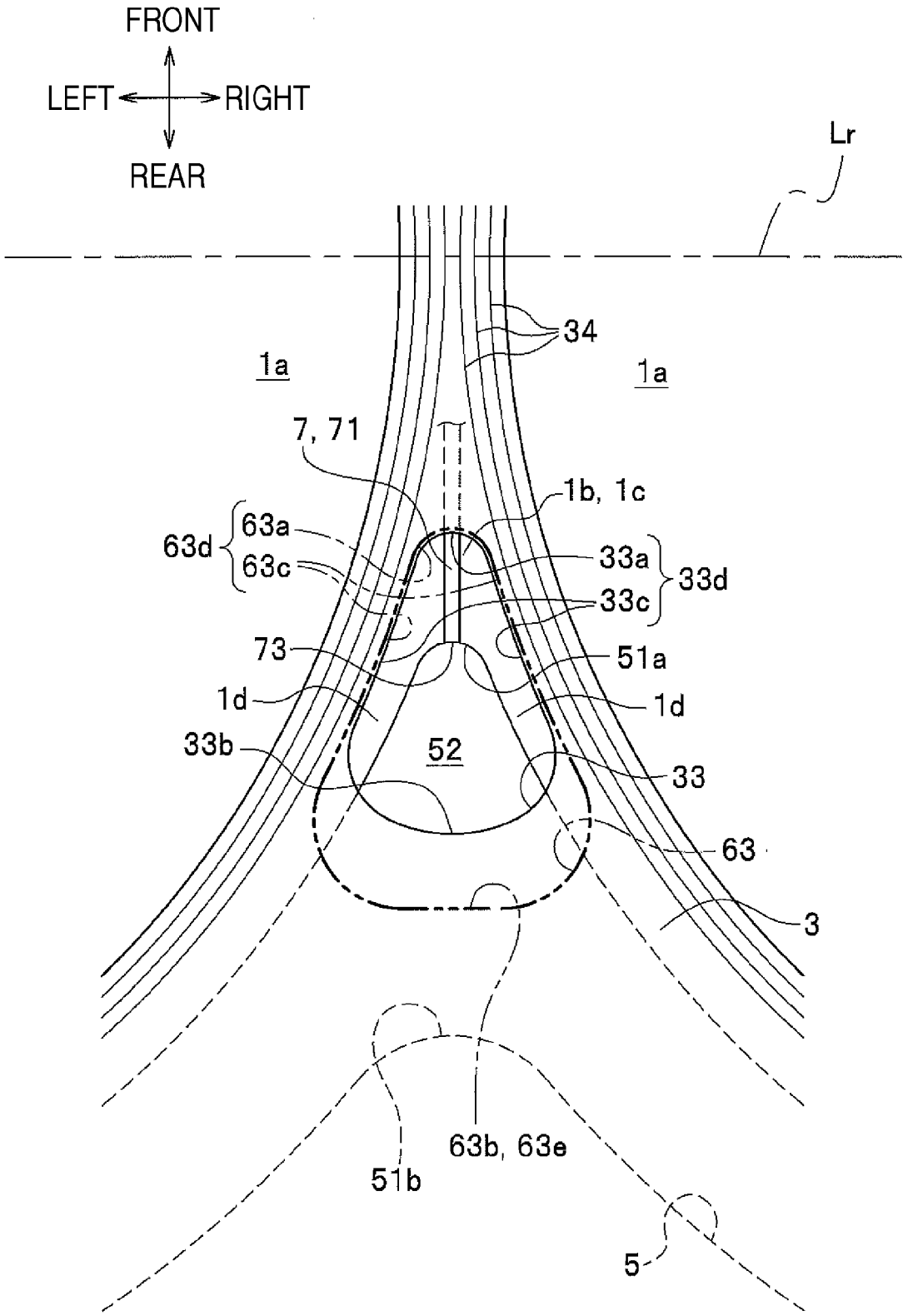
FIG. 12 is a plan view of the inter-bore region and its periphery.

As illustrated in FIGS. 10 to 12, the recessed groove 7 is a coolant passage through which coolant flows and has a function of cooling the inter-bore region which is likely to have a relatively high temperature. The recessed groove 7 is a groove which is recessedly provided on the top surface 1*c* of the partition wall 1*b*, and mainly allows the constricted portion 52 on the front side and the constricted portion 52 on the rear side to communicate with each other. The halves of the block-side coolant passage 5 in the front and rear of FIG. 10 have a pressure difference therebetween, and the pressure causes the coolant to flow through the recessed groove 7. The recessed groove 7 is provided extending in a direction perpendicular to the cylinder bank center line Lr, for example. The recessed groove 7 is formed to have a substantially constant rectangular cross-section, and the depth and width of the groove are approximately 2 mm each, for example.

In the inter-bore region, the inner end 51*a* of the block opening 51 is offset opposite to the cylinder bank center line Lr with respect to the inner end 63*d* of the head opening 63 and the inner end 33*d* of the intermediate communication hole 33. In other words, in the cross-section illustrated in FIG.

10, width D1 between the inner ends 63*d*, 63*d* of the head opening 63 in the front and rear direction is smaller than width D2 between the inner ends 51*a*, 51*a* of the block opening 51 in the front and rear direction. In addition, the inner end 33*d* of the intermediate communication hole 33 is formed to be flush with (at the same position as) the inner end 63*d* of the head opening 63. Consequently, the top surface 1*c* of the inter-bore region is exposed from the intermediate communication hole 33. These details are the same as those of the above-describe first and second embodiments.

As illustrated in FIGS. 10 to 12, the recessed groove 7 has an upper edge opening 71 which are open through the top surface 1*c* of the partition wall 1*b*, and a front end opening 72 and a rear end opening 73 which are open to the constricted portions 52, 52 in the front and rear, respectively. The top surface 1*c* of the inter-bore region is exposed from the intermediate communication hole 33, and accordingly, the vicinities of both ends of the recessed groove 7, that is, the vicinities of the front and rear ends of the upper edge opening 71 of the recessed groove 7 are also exposed from the intermediate communication hole 33 in the front and rear. On the other hand, the central part of the upper edge opening 71 in the front and rear direction is closed by the gasket 3. In this manner, the recessed groove 7 allows coolant to flow in or out through not only the front end opening 72 and the rear end opening 73, but also the front and rear ends of the upper edge opening 71, and thus the coolant may be properly passed through the recessed groove 7.

When the recessed groove 7 is formed on the top surface 1*c* of the partition wall 1*b*, explosive energy in a combustion chamber (not illustrated) may cause stress concentration at the base near the front and rear openings 72, 73 of the recessed groove 7. Although smaller than the explosive energy in the combustion chamber, the fastening load of the cylinder block 1 and the cylinder head 2 may also cause stress concentration at the base near the front and rear openings 72, 73 of the recessed groove 7. To cope with this, in the third embodiment, the width between the constricted portions 52 (the degree of closeness of the constricted portions 52 to the cylinder bank center line Lr) is made larger compared with the comparative example illustrated in FIG. 6B. Accordingly, the inner ends 51*a* of the constricted portions 52 have a reduced curvature, and thus the stress concentration at the base near the front and rear openings 72, 73 of the recessed groove 7 may be relieved.

As described above, with the cooling structure 10A of an internal combustion engine according the third embodiment, the inter-bore region, which is likely to have a relatively high temperature, may be efficiently cooled by the recessed groove 7. In addition, the vicinities of the front and rear ends of the upper edge opening 71 of the recessed groove 7 are exposed from the intermediate communication hole 33, and thus coolant flows through the recessed groove 7 easily. Reducing the curvature of the inner ends 51*a* of the constricted portions 52 may relieve the stress concentration at the base near the front and rear openings 72, 73 of the recessed groove 7.

Although the stress concentration is relieved by increasing the width between the inner ends 51*a* of the constricted portions 52 in the third embodiment, in the case where the stress concentration is trivial, the inner end 63*d* of the head opening 63 and the inner end 33*d* of the intermediate communication hole 33 may be offset toward the cylinder bank center line Lr without changing the width between the inner ends 51*a* of the constricted portions 52, for example. Thus, the vicinities of the front and rear ends of the upper edge opening 71 of the recessed groove 7 may be exposed from the intermediate communication hole 33.

Hereinafter, first and second modifications of the cooling structure 10A of an internal combustion engine according to the third embodiment will be described with reference to FIGS. 13A and 13B. Because the first and second modifications each have a front and rear symmetrical structure, only the rear half is illustrated and the front half is not illustrated.

Figure 13A:
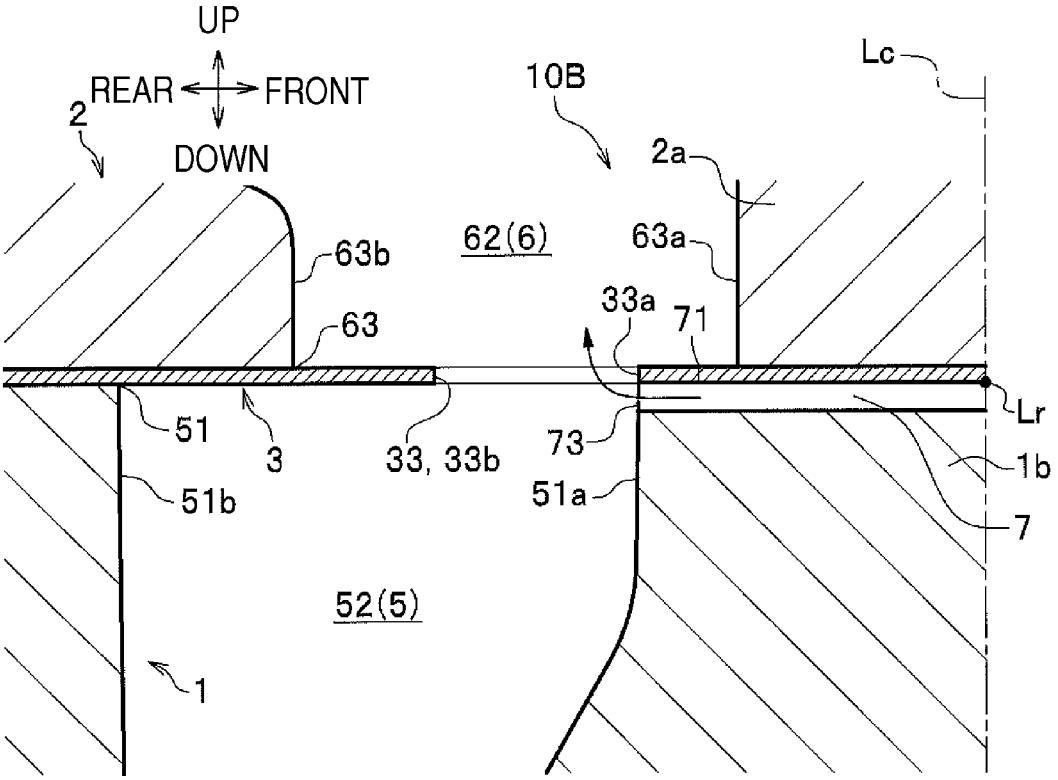
FIG. 13A is an enlarged partial cross-sectional view of a cooling structure of an internal combustion engine according to a first modification.

As illustrated in FIG. 13A, the cooling structure 10B of an internal combustion engine according to the first modification differs from the cooling structure 10A according to the above-described third embodiment in that the upper edge opening 71 of the recessed groove 7 is covered by the gasket 3 over the entire length. That is, only the front end opening 72 (see FIG. 10) and the rear end opening 73 of the recessed groove 7 communicate with the block-side coolant passage 5 (constricted portions 52). Even with such a structure, the inter-bore region may be properly cooled by the recessed groove 7. However, in the recessed groove 7 in the third embodiment, the upper edge opening 71 in addition to the front and rear openings 72, 73 serves as an inlet/outlet for coolant, and thus the coolant flows easily.

Figure 13B:
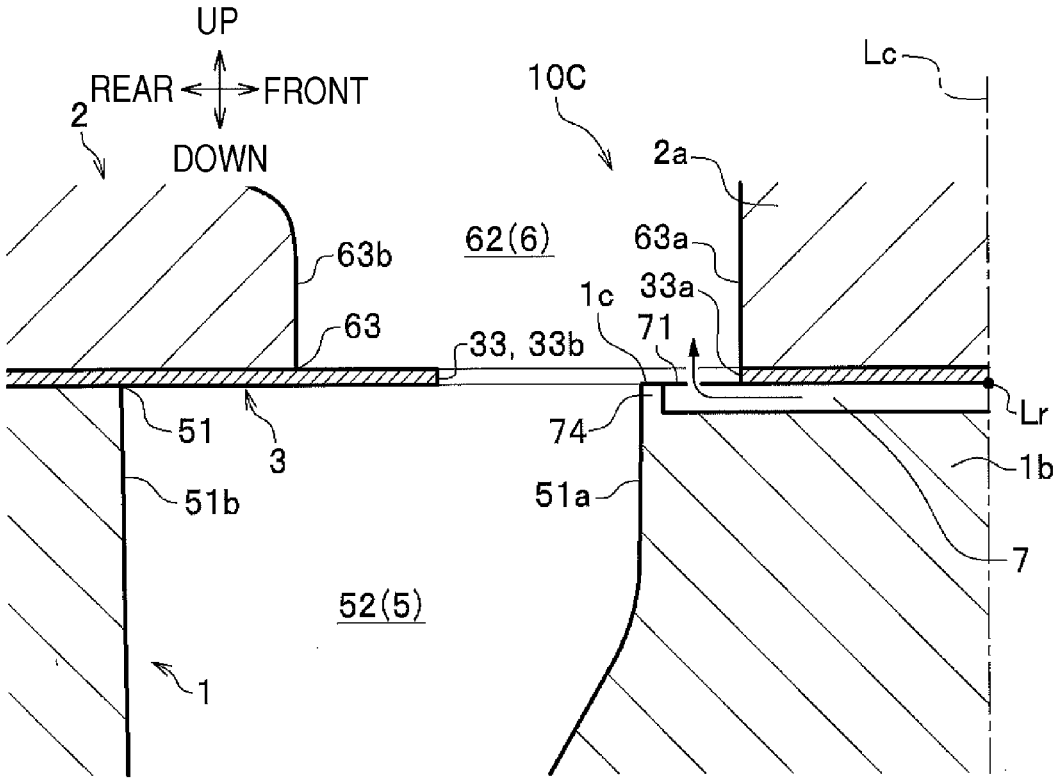
FIG. 13B is an enlarged partial cross-sectional view of a cooling structure of an internal combustion engine according to a second modification.

As illustrated in FIG. 13B, the cooling structure 10B of an internal combustion engine according to the second modification differs from the cooling structure 10A according to the above-described third embodiment in that the front and rear ends (only the rear side is illustrated) of the recessed groove 7 is not in communication with the constricted portion 52. That is, in the cooling structure 100 of an internal combustion engine, only the vicinities of the front and rear ends of the upper edge opening 71 of the recessed groove 7 exposed from the intermediate communication hole 33 are in communication with the intermediate inflow portions 62 of the head-side coolant passage 6. On the other hand, wall 74 is left at the front and rear ends (only the rear side is illustrated) of the recessed groove 7. Therefore, the coolant, which has flown through the recessed groove 7, flows out to the head-side coolant passage 6 through the upper edge opening 71 and the intermediate communication hole 33, and does not flow out directly to the constricted portion 52. Even with such a structure, the inter-bore region may be properly cooled by the recessed groove 7. The coolant, which has flown through the recessed groove 7, flows out directly to the head-side coolant passage 6, and thus the combustion chamber periphery 2*a* may be properly cooled.

In the third embodiment and the first and second modifications, the recessed groove 7 and its peripheral structure each have a front and rear symmetrical structure. However, the present disclosure is not limited to this, and the structures described in the third embodiment and the first and second modifications may be used independently of the front and rear sides and combined. For example, the structure on the front side may allow coolant to flow into the recessed groove 7 from the upper edge opening 71 and the front end opening 72 (see FIG. 10) as in the third embodiment, and the structure on the rear side may allow only the upper edge opening 71 to communicate with the head-side coolant passage 6 as in the second modification. In this manner, coolant flows into the recessed groove 7 easily and the combustion chamber periphery 2*a* may be properly cooled.

The embodiments of the present disclosure provides a cooling structure (10) in which a plurality of cylinder bores (1*a*) are disposed in series, the cooling structure including: a cylinder block (1) provided with a block-side coolant passage (5) which surrounds an entire circumference of the cylinder bores (1*a*); a cylinder head (2) provided with a head-side coolant passage (6); and a gasket (3) interposed between the cylinder block and the cylinder head. The block-side coolant passage (5) has a block opening (51) which is open through a surface of the cylinder block, the surface facing the cylinder head, and the head-side coolant passage (6) has a head opening (63) which is open through a surface of the cylinder head, the surface facing the cylinder block, the gasket has a plurality of communication holes (33) on opposite sides with respect to a cylinder bank center line (Lr), the communication holes communicating with the block opening and the head opening in an inter-bore region (1*b*, 1*d*) which separates adjacent cylinder bores, and in a cross-section through the inter-bore region (1*b*, 1*d*) and perpendicular to the cylinder bank center line (Lr), ends (63*d*) of a pair of the head openings (63) provided on the opposite sides with respect to the cylinder bank center line, the ends facing the cylinder bank center line are disposed nearer to the cylinder bank center line (Lr) than ends (51*a*) of a pair of the block openings (51) provided on the opposite sides with respect to the cylinder bank center line, the ends facing the cylinder bank center line, and ends (33*d*) of the communication holes (33) that face the cylinder bank center line are provided between the ends (63*d*) of the head openings (63) that face the cylinder bank center line and the ends (51*a*) of the block openings (51) that face the cylinder bank center line.

With this configuration of the embodiments, in a cross-section through the inter-bore region (1*b*, 1*d*) and perpendicular to the cylinder bank center line (Lr), the ends (63*d*) of a pair of the head openings (63) provided on the opposite sides with respect to the cylinder bank center line, the ends facing the cylinder bank center line are disposed nearer to the cylinder bank center line (Lr) than the ends (51*a*) of a pair of the block openings (51) provided on the opposite sides with respect to the cylinder bank center line, the ends facing the cylinder bank center line, and the ends (33*d*) of the communication holes (33) that face the cylinder bank center line are provided between the ends (63*d*) of the head openings (63) that face the cylinder bank center line and the ends (51*a*) of the block openings (51) that face the cylinder bank center line. Thus, the ends (63*d*) of the head openings (63) that face the cylinder bank center line are not present as resistance to the coolant above the ends (51*a*) of the block openings (51) that face the cylinder bank center line. For this reason, over the ends (51*a*) of the block openings (51) that face the cylinder bank center line, decrease in the flow velocity of the coolant which flows in the head-side coolant passage (6) is reduced. Consequently, decrease in the flow velocity of the coolant is reduced and the efficiency in cooling the inter-bore region (1*b*, 1*d*) is improved also at the ends (51*a*) of the block openings (51) that face the cylinder bank center line. With this configuration, coolant is supplied between the ends (63*d*) of the head openings (63) that face the cylinder bank center line and the ends (51*a*) of the block openings (51) that face the cylinder bank center line through the head-side coolant passage (6), and thus a top surface (1*c*) of the inter-bore region corresponding to this section is cooled by the coolant and the efficiency in cooling the inter-bore region (1*b*, 1*d*) is improved. In addition, with this configuration, the coolant, which flows out through the block openings (51) of the block-side coolant passage (5) and flows in the head-side coolant passage (6) through the communication holes (33) of the gasket (3) and the head openings (63), is likely to flow in the direction toward the cylinder bank center line (Lr) (that is, in the direction toward the inter-bore region (1*b*, 1*d*)), and thus the efficiency in cooling the inter-bore region (1*b*, 1*d*) is improved.

In the embodiments, the communication holes (33) are each preferably formed in a tapered shape along peripheral walls of the cylinder bores (1*a*) such that a width of each of the communication holes in a direction of the cylinder bank center line (Lr) is narrower as the communication hole is closer to the cylinder bank center line (Lr). With this configuration, in a range not interfering with the cylinder bores (1*a*) (more specifically, seal lines (34) of the cylinder bores (1*a*)), the ends (33*d*) of the communication holes (33) that face the cylinder bank center line may be disposed near the cylinder bank center line (Lr) as much as possible, and thus the efficiency in cooling the inter-bore region (1*b*, 1*d*) may be improved by increasing the exposed range of the top surface (1*c*) of the inter-bore region.

In the embodiments, ends (33*b*) of the communication holes (33) that are opposite to the cylinder bank center line are each preferably provided with an extending portion (35) which extends towards the block-side coolant passage (5). With this configuration, the flow velocity of the coolant near the ends (33*b*) of the communication holes (33) that are opposite to the cylinder bank center line is reduced by the extending portion (35) which extends towards the block-side coolant passage. Accordingly, a large difference occurs between the velocities of coolant at one side of the communication holes (33) that faces the cylinder bank center line and the other side, and thus the coolant is more likely to flow toward the cylinder bank center line (Lr) (that is, toward the inter-bore region (1*b*, 1*d*)). Consequently, the efficiency in cooling the inter-bore region (1*b*, 1*d*) may be further improved.

In the embodiments, the ends (33*d*) of the communication holes (33) that face the cylinder bank center line are each preferably provided at the same position as the end (63*d*) of a corresponding one of the head openings (63) that faces the cylinder bank center line. With this configuration, the efficiency in cooling the inter-bore region (1*b*, 1*d*) may be improved by increasing the exposed range of the top surface (1*c*) of the inter-bore region to a maximum.

The embodiments of the present disclosure provides a cooling structure (10A) of an internal combustion engine, in which a plurality of cylinder bores (1*a*) are disposed in series, the cooling structure including: a cylinder block (1) provided with a block-side coolant passage (5) which surrounds an entire circumference of the cylinder bores (1*a*); a cylinder head (2) provided with a head-side coolant passage (6); and a gasket (3) interposed between the cylinder block and the cylinder head. The block-side coolant passage (5) has a block opening (51) which is open through a surface of the cylinder block, the surface facing the cylinder head, and the head-side coolant passage (6) has a head opening (63) which is open through a surface of the cylinder head, the surface facing the cylinder block, the gasket (3) has a plurality of communication holes (33) on opposite sides with respect to a cylinder bank center line (Lr), the communication holes communicating with the block opening and the head opening in an inter-bore region (1*c*, 1*d*) which separates adjacent cylinder bores, in a cross-section through the inter-bore region (1*c*, 1*d*) and perpendicular to the cylinder bank center line (Lr), ends (63*d*) of a pair of the head openings (63) provided on the opposite sides with respect to the cylinder bank center line (Lr), the ends facing the cylinder bank center line are disposed nearer to the cylinder bank center line (Lr) than ends (51*a*) of a pair of the block openings (51) provided on the opposite sides with respect to the cylinder bank center line, the ends facing the cylinder bank center line, and ends (33*d*) of the communication holes (33) that face the cylinder bank center line are disposed nearer to the cylinder bank center line than the ends (51*a*) of the block openings (51) that face the cylinder bank center line, and a top surface (1*c*) of the inter-bore region has a recessed groove (7), and both ends (71) of the recessed groove (7) are exposed from the respective communication holes (33) on both sides of the cylinder bank center line (Lr). With such a configuration, the inter-bore region (1*c*, 1*d*), which is likely to have a relatively high temperature, may be efficiently cooled by the coolant which flows through the recessed groove (7). In addition, both ends (71) of the recessed groove (7) are exposed from the communication holes (33) on both sides of the cylinder bank center line (Lr), and thus the coolant flows into or out from the recessed groove (7) easily.

The embodiments of the present disclosure provides a cooling structure (10A) of an internal combustion engine, in which a plurality of cylinder bores (1*a*) are disposed in series, the cooling structure including: a cylinder block (1) provided with a block-side coolant passage (5) which surrounds an entire circumference of the cylinder bores (1*a*); a cylinder head (2) provided with a head-side coolant passage (6); and a gasket (3) interposed between the cylinder block and the cylinder head. The block-side coolant passage (5) has a block opening (51) which is open through a surface of the cylinder block, the surface facing the cylinder head, and the head-side coolant passage (6) has a head opening (63) which is open through a surface of the cylinder head, the surface facing the cylinder block, the gasket (3) has a plurality of communication holes (33) on opposite sides with respect to a cylinder bank center line (Lr), the communication holes communicating with the block opening and the head opening in an inter-bore region (1*c*, 1*d*) which separates adjacent cylinder bores, in a cross-section through the inter-bore region (1*c*, 1*d*) and perpendicular to the cylinder bank center line (Lr), ends (63*d*) of a pair of the head openings (63) provided on the opposite sides with respect to the cylinder bank center line (Lr), the ends facing the cylinder bank center line are disposed nearer to the cylinder bank center line (Lr) than ends (51*a*) of a pair of the block openings (51) provided on the opposite sides with respect to the cylinder bank center line, the ends facing the cylinder bank center line, and ends (33*d*) of the communication holes (33) that face the cylinder bank center line are provided between the ends (63*d*) of the head openings (63) that face the cylinder bank center line and the ends (51*a*) of the block openings (51) that face the cylinder bank center line, and a top surface (1*c*) of the inter-bore region has a recessed groove (7), and the recessed groove (7) allows halves of the block-side coolant passage (5) on both sides of the cylinder bank center line to communicate with each other. With such a configuration, the inter-bore region (1*c*, 1*d*), which is likely to have a relatively high temperature, may be efficiently cooled by the coolant which flows through the recessed groove (7). In addition, the recessed groove (7) allows halves of the block-side coolant passage (5) on both sides of the cylinder bank center line to communicate with each other, and thus the coolant, which flows through the block-side coolant passage (5), may be properly guided to the recessed groove (7). It should be noted for the sake of clarity that "between the ends (63*d*) of the head openings (63) that face the cylinder bank center line and the ends (51*a*) of the block openings (51) that face the cylinder bank center line" includes "the same positions as the ends (63*d*)" and "the same positions as the ends (51*a*)".

Obviously, numerous modifications and variations of the present invention are possible in light of the above teachings. It is therefore to be understood that within the scope of the appended claims, the invention may be practiced otherwise than as specifically described herein.

What is claimed is:

1. A cooling structure of an internal combustion engine, the cooling structure comprising:

a cylinder block including a block-side coolant passage which surrounds an entire circumference of cylinder bores which are arranged along a cylinder bank center line in the internal combustion engine, the block-side coolant passage having a block opening which is open through a first surface of the cylinder block;

a cylinder head including a head-side coolant passage having a head opening which is open through a second surface of the cylinder head, the second surface facing toward the cylinder block, the first surface of the cylinder block facing toward the cylinder head; and a gasket provided between the cylinder block and the cylinder head, the gasket having a first communication hole and a second communication hole provided on an opposite side of the first communication hole with respect to the cylinder bank center line, each of the first communication hole and the second communication hole communicating with the block opening and the head opening in an inter-bore region which separates adjacent cylinder bores, the head opening including a first end and a second end provided on an opposite side of the first end with respect to the cylinder bank center line, the block opening including a third end and a fourth end provided on an opposite side of the third end with respect to the cylinder bank center line, wherein, in a cross-section defined through the inter-bore region and perpendicular to the cylinder bank center line, the first end and the second end which face toward the cylinder bank center line are disposed nearer to the cylinder bank center line than the third end and the fourth end which face toward the cylinder bank center line, respectively, wherein, in the cross-section, a fifth end of the first communication hole facing toward the cylinder bank center line is provided between the first end of the head opening and the third end of the block opening, and wherein, in the cross-section, a sixth end of the second communication hole facing toward the cylinder bank center line is provided between the second end of the head opening and the fourth end of the block opening, and wherein, in the cross-section, the fifth end and the sixth end are disposed nearer to the cylinder bank center line than the third end and the fourth end, respectively.

2. The cooling structure of an internal combustion engine according to claim 1, wherein the first communication hole is provided in a tapered shape along peripheral walls of the cylinder bores such that a width of the first communication hole in a direction of the cylinder bank center line is narrower as the first communication hole is closer to the cylinder bank center line, and wherein the second communication hole is provided in a tapered shape along peripheral walls of the cylinder bores such that a width of the second communication hole in the direction of the cylinder bank center line is narrower as the second communication hole is closer to the cylinder bank center line.

3. The cooling structure of an internal combustion engine according to claim 1, wherein the gasket includes a first extending portion and a second extending portion, wherein the first extending portion is provided at an end of the first communication hole opposite to the cylinder bank center line and extends towards the block-side coolant passage, and wherein the second extending portion is provided at an end of the second communication hole opposite to the cylinder bank center line and extends towards the block-side coolant passage.

4. The cooling structure of an internal combustion engine according to claim 1, wherein the fifth end of the first communication hole is provided at a same position as the first end of the head opening, and wherein the sixth end of the second communication hole is provided at a same position as the second end of the head opening.

5. The cooling structure of an internal combustion engine according to claim 1, wherein the gasket includes a first extending portion formed by a protrusion that extends from a portion of the gasket that surrounds the first communication hole.

6. The cooling structure of an internal combustion engine according to claim 5, wherein the extending portion is formed by a region of increased thickness of the gasket, the extending portion extending downward from the portion of the gasket that surrounds the first communication hole.

7. A cooling structure of an internal combustion engine, the cooling structure comprising:

a cylinder block including a block-side coolant passage which surrounds an entire circumference of the cylinder bores which are arranged along a cylinder bank center line in the internal combustion engine, the block-side coolant passage having a block opening which is open through a first surface of the cylinder block;

a cylinder head including a head-side coolant passage, the head-side coolant passage having a head opening which is open through a surface of the cylinder head, the second surface facing toward the cylinder block, the first surface facing toward the cylinder head; and a gasket provided between the cylinder block and the cylinder head, the gasket having a first communication hole and a second communication hole provided on an opposite side of the first communication hole with respect to the cylinder bank center line, each of the first communication hole and the second communication hole communicating with the block opening and the head opening in an inter-bore region which separates adjacent cylinder bores, the head opening including a first end and a second end provided on an opposite side of the first end with respect to the cylinder bank center line, the block opening including a third end and a fourth end provided on an opposite side of the third end with respect to the cylinder bank center line, wherein, in a cross-section defined through the inter-bore region and perpendicular to the cylinder bank center line, the first end and the second end which face toward the cylinder bank center line are disposed nearer to the cylinder bank center line than the third end and the fourth end which face toward the cylinder bank center line, respectively, wherein, in the cross-section, a fifth end of the first communication hole facing toward the cylinder bank center line is disposed nearer to the cylinder bank center line than the third end and the fourth end of the block openings which face toward the cylinder bank center line, and wherein a top surface of the inter-bore region has a recessed groove, and a front end opening and a rear end opening of the recessed groove are exposed from the first communication hole and the second communication hole which are provided on both sides of the cylinder bank center line.

8. The cooling structure according to claim 7, wherein the recessed groove is directly connected to the first communication hole and the second communication hole at the front end opening and the rear end opening, respectively.

9. A cooling structure of an internal combustion engine, the cooling structure comprising:

a cylinder block including a block-side coolant passage which surrounds an entire circumference of the cylinder bores which are arranged along a cylinder bank center line in the internal combustion engine, the block-side coolant passage having a block opening which is open through a first surface of the cylinder block;

a cylinder head including a head-side coolant passage, the head-side coolant passage having a head opening which is open through a surface of the cylinder head, the second surface facing toward the cylinder block, the first surface facing toward the cylinder head; and a gasket provided between the cylinder block and the cylinder head, the gasket having a first communication hole and a second communication hole provided on an opposite side of the first communication hole with respect to the cylinder bank center line, each of the first communication hole and the second communication hole communicating with the block opening and the head opening in an inter-bore region which separates adjacent cylinder bores, the head opening including a first end and a second end provided on an opposite side of the first end with respect to the cylinder bank center line, the block opening including a third end and a fourth end provided on an opposite side of the third end with respect to the cylinder bank center line, wherein, in a cross-section defined through the inter-bore region and perpendicular to the cylinder bank center line, the first end and the second end which face toward the cylinder bank center line are disposed nearer to the cylinder bank center line than the third end and the fourth end which face toward the cylinder bank center line, respectively, wherein, in the cross-section, a fifth end of the first communication hole facing toward the cylinder bank center line is disposed nearer to the cylinder bank center line than the third end and the fourth end of the block openings which face toward the cylinder bank center line, and wherein a top surface of the inter-bore region has a recessed groove, and the recessed groove allows halves of the block-side coolant passage on both sides of the cylinder bank center line to communicate with each other.

10. The cooling structure according to claim 9, wherein the cylinder block includes a wall to redirect coolant traveling through the recessed groove to a direction toward the head-side coolant passage.

* * * * *